US009659536B2

(12) United States Patent
Ryu et al.

(10) Patent No.: US 9,659,536 B2
(45) Date of Patent: May 23, 2017

(54) LIQUID CRYSTAL DISPLAY

(71) Applicant: Samsung Display Co., Ltd., Yongin (KR)

(72) Inventors: Jang Wi Ryu, Seoul (KR); Hak Sun Chang, Yongin-si (KR); Ki Chul Shin, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 304 days.

(21) Appl. No.: 14/611,886

(22) Filed: Feb. 2, 2015

(65) Prior Publication Data

US 2015/0243240 A1 Aug. 27, 2015

(30) Foreign Application Priority Data

Feb. 25, 2014 (KR) ..... 10-2014-0022145

(51) Int. Cl.
*G09G 3/36* (2006.01)

(52) U.S. Cl.
CPC ..... *G09G 3/3607* (2013.01); *G09G 3/3648* (2013.01); *G09G 3/3659* (2013.01); *G09G 2300/0426* (2013.01); *G09G 2300/0447* (2013.01); *G09G 2300/0876* (2013.01); *G09G 2320/028* (2013.01)

(58) Field of Classification Search
CPC .. G09G 3/3607; G09G 3/3648; G09G 3/3659; G09G 2320/028; G09G 2300/0447; G09G 2300/0876; G09G 2300/0426; G09G 3/3696; G09G 3/36
See application file for complete search history.

(56) References Cited

U.S. PATENT DOCUMENTS

2010/0079473 A1* 4/2010 Choi ..... G09G 3/3648 345/545
2013/0077006 A1* 3/2013 Jung ..... G02F 1/134363 349/41
2015/0146126 A1* 5/2015 Shin ..... G02F 1/134309 349/43

FOREIGN PATENT DOCUMENTS

KR 10-2012-0124011 11/2012
KR 10-2012-0124012 11/2012
KR 10-2013-0091218 8/2013
KR 10-2014-0113035 9/2014

* cited by examiner

*Primary Examiner* — Andrew Sasinowski
*Assistant Examiner* — Gerald Oliver
(74) *Attorney, Agent, or Firm* — H.C. Park & Associates, PLC

(57) ABSTRACT

A liquid crystal display device includes a plurality of pixels disposed on an insulation substrate in a horizontal direction, and including a thin film transistor region and a display area; and a reference voltage line extended along a center of the display area in a direction perpendicular to the horizontal direction. The display area includes a plurality of domains disposed in two rows, a domain in one of the two rows includes a high-gray subpixel area including a high-gray pixel electrode, and a domain in the other of the two rows includes a low-gray subpixel area including a low-gray pixel electrode. The high-gray pixel electrode and the low-gray pixel electrode each include a plurality of unit pixel electrodes, and each unit pixel electrode includes a center electrode having a planar structure and a plurality of minute branches that extend from a side of the center electrode.

19 Claims, 25 Drawing Sheets

LIQUID CRYSTAL DISPLAY

CROSS REFERENCE TO RELATED APPLICATION

This application claims priority from and the benefit of Korean Patent Application No. 10-2014-0022145, filed on Feb. 25, 2014, which is hereby incorporated by reference for all purposes as if fully set forth herein.

BACKGROUND

Field

Exemplary embodiments of the present invention relates to a liquid crystal display.

Discussion of the Background

A liquid crystal display, which is one of the most common types of flat panel displays currently in use, typically includes two display panel sheets, field generating electrodes, such as a pixel electrode, a common electrode, and the like, and a liquid crystal layer interposed therebetween. The liquid crystal display device may generate an electric field in the liquid crystal layer by applying voltages to the field generating electrodes. The electric field may determine the direction of liquid crystal molecules of the liquid crystal layer, thus controlling polarization of incident light so as to display images.

A vertical aligned mode liquid crystal display device, in which liquid crystal molecules are aligned so that long axes of the liquid crystal molecules are perpendicular to a display panel while no electric field is applied, has been developed.

In the vertical alignment (VA) mode liquid crystal display, a wide viewing angle can be realized by forming cutouts, such as minute slits, in the field-generating electrodes. Since the cutouts as well as protrusions can determine the tilt directions of the liquid crystal (LC) molecules, the tilt directions can be varied by using cutouts and protrusions such that the reference viewing angle is widened.

When forming the minute slits in the pixel electrode to have a plurality of branch electrodes, the response speed of the liquid crystal molecules is deteriorated due to a relationship with other liquid crystal control forces of the liquid crystal molecules as well as the minute slits, such that texture may be displayed over time.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a liquid crystal display for improving a low-gray lifting phenomenon and lateral visibility by deforming a high-gray pixel electrode and a common electrode facing the high-gray pixel electrode.

Additional features of the invention will be set forth in the description which follows, and in part will be apparent from the description, or may be learned by practice of the invention.

An exemplary embodiment of the present invention discloses a liquid crystal display including: A liquid crystal display device includes a plurality of pixels disposed on an insulation substrate in a horizontal direction, and including a thin film transistor region and a display area; and a reference voltage line extended along a center of the display area in a direction perpendicular to the horizontal direction. The display area includes a plurality of domains disposed in two rows, a domain in one of the two rows includes a high-gray subpixel area including a high-gray pixel electrode, and a domain in the other of the two rows includes a low-gray subpixel area including a low-gray pixel electrode. The high-gray pixel electrode and the low-gray pixel electrode each include a plurality of unit pixel electrodes, and each unit pixel electrode includes a center electrode having a planar structure and a plurality of minute branches that extend from a side of the center electrode.

An exemplary embodiment of the present invention also discloses a liquid crystal display including: a plurality of pixels formed on an insulation substrate, formed in a horizontal direction, and including a thin film transistor forming region and a display area; and a reference voltage line extended in a perpendicular direction along a center of the display area. The display area includes a plurality of domains disposed in two rows. The domain in one of the two rows is a high-gray subpixel area in which a high-gray pixel electrode is provided and a domain in the other thereof is a low-gray subpixel area in which a low-gray pixel electrode is provided. The high-gray pixel electrode and the low-gray pixel electrode each include a plurality of unit pixel electrodes. Common electrodes respectively facing the high-gray pixel electrode and the low-gray pixel electrode are included. A horizontal opening and a perpendicular opening crossing the same are formed in the common electrode. The horizontal opening of the common electrode facing the unit pixel electrode of the high-gray pixel electrode is shorter than the horizontal opening of the common electrode facing the unit pixel electrode of the low-gray pixel electrode.

An exemplary embodiment of the present invention also discloses a liquid crystal display including: a plurality of pixels formed on an insulation substrate, formed in a perpendicular direction, and including a thin film transistor forming region and a display area; and a gate line progressing in a horizontal direction along a center of the display area. The display area includes a plurality of domains that are arranged in two columns. A domain provided on an upper part with respect to the gate line is a high-gray subpixel area in which a high-gray subpixel electrode is provided, and a domain provided on a lower part with respect to the gate line is a low-gray subpixel area in which a low-gray pixel electrode is provided. The high-gray pixel electrode and the low-gray pixel electrode each include a plurality of unit pixel electrodes. Common electrodes facing the high-gray pixel electrode and the low-gray pixel electrode are included. A horizontal opening and a perpendicular opening crossing the same are formed in the common electrode. The horizontal opening of the common electrode facing the unit pixel electrode of the high-gray pixel electrode is shorter than the horizontal opening of the common electrode facing the unit pixel electrode of the low-gray pixel electrode.

According to the exemplary embodiments of the present invention, the liquid crystal display controls arrangement of the angle of the liquid crystal molecules by reducing the width of the center electrode of the high-gray pixel electrode or decreasing the length of the horizontal opening of the common electrode facing the high-gray pixel electrode. The lifting phenomenon in the low gray induced by the arrangement of the angle of the liquid crystal molecules is improved, and the lateral visibility is improved. Transmittance is also improved together with visibility.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
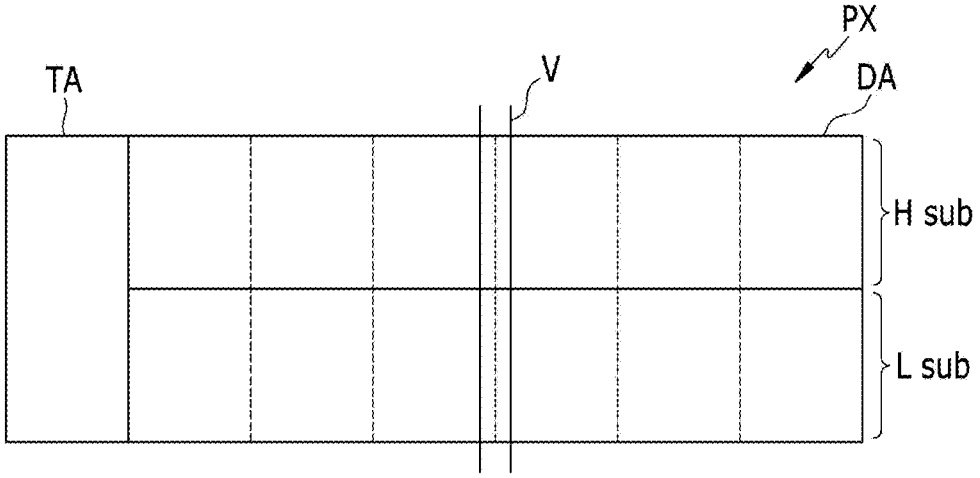
FIG. 1 shows a schematic diagram of a pixel according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

A liquid crystal display according to an exemplary embodiment of the present invention will now be described with reference to accompanying drawings.

FIG. 1 shows a schematic diagram of a pixel according to an exemplary embodiment of the present invention.

According to an exemplary embodiment of the present invention, one pixel PX is a transverse type of pixel that is elongated in the transverse direction. Also, one pixel PX includes a thin film transistor formation area (TA), and a display area (DA). The pixel electrode is formed at the display area (DA), and an image may be displayed by liquid crystal molecules positioned at the display area (DA). The thin film transistor formation area (TA) includes an element and wiring, such as a thin film transistor, that may transmit a voltage to be applied to the pixel electrode of the display area (DA).

In the pixel PX according to the exemplary embodiment of FIG. 1, a reference voltage line (V) is positioned in the vertical direction in the center of the display area (DA). The display area (DA) is divided into two subpixel areas including a high-gray subpixel area (H sub) and a low-gray subpixel area (L sub). The high-gray subpixel area (H sub) and the low-gray subpixel area (L sub) extend in a direction perpendicular to the voltage line V. According to the exemplary embodiment shown in FIG. 1, the high-gray subpixel area (H sub) is provided to an upper side of the display area (DA) and the low-gray subpixel area (L sub) is provided to a lower side of the display area (DA). As a result, the reference voltage line (V) passes through the center of the high-gray subpixel area (H sub) and the low-gray subpixel area (L sub).

Each of the subpixel areas (H sub, L sub) includes six domains. The domains are divided by dotted lines in FIG. 1, and solid lines indicate a boundary of the subpixel areas (H sub, L sub). That is, one pixel is divided into an upper portion and a lower portion. One pixel (PX) includes twelve domains and each of the subpixel areas (H sub, L sub) includes six domains. The number 12 is variable depending on the embodiments, so one pixel (PX) may be divided into an even-number of personal domains. Further, the reference voltage line (V) divides the twelve domains into two parts, such that the low-gray subpixel area (L sub) and the high-gray subpixel area (H sub) are divided into two parts by the reference voltage line (V), respectively. As a result, the right and left parts are indicated as symmetrical with respect to the reference voltage line (V).

An entire configuration of the pixel configured with the pixel electrode, the common electrode, and the reference voltage line will now be described with reference to FIG. 2.

Figure 2:
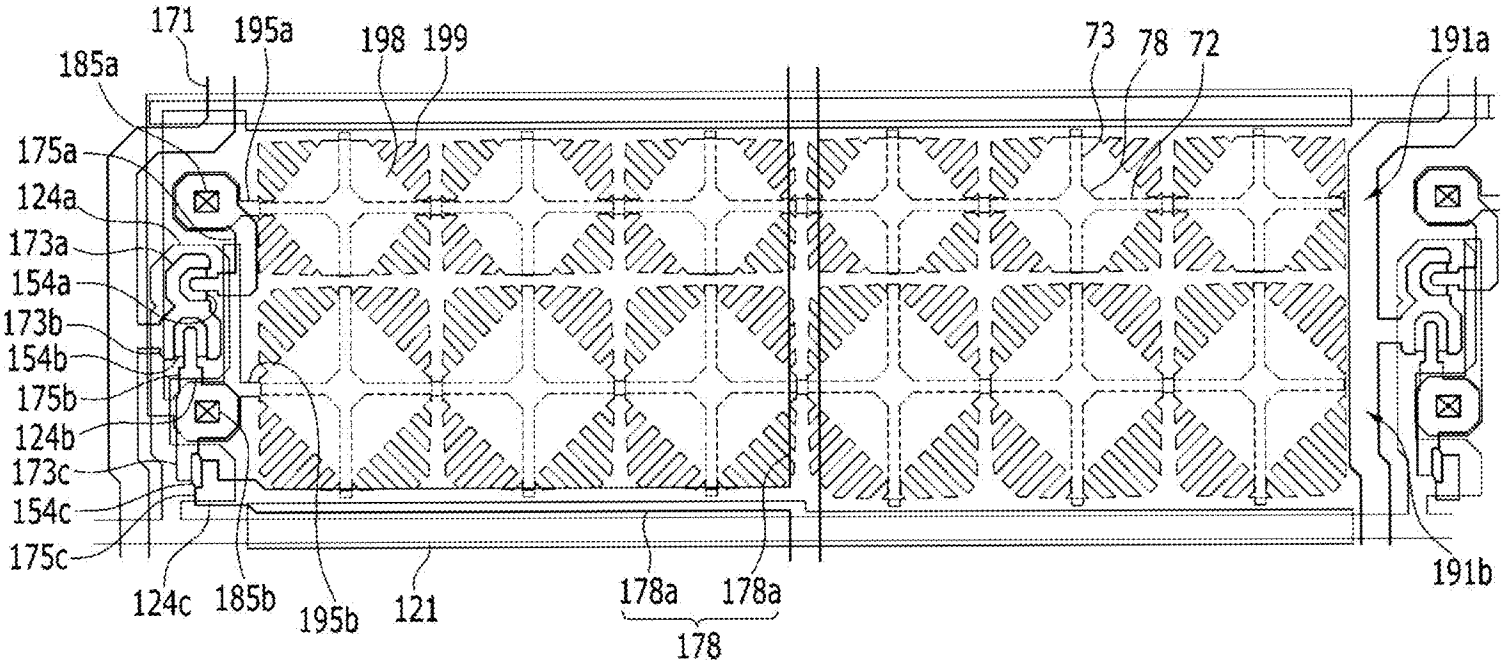
FIG. 2 shows a detailed configuration of a pixel according to an exemplary embodiment of the present invention.

FIG. 2 shows a detailed configuration of a pixel according to an exemplary embodiment of the present invention.

Gate line 121, which may be provided in plurality, is provided on an insulation substrate on the lower panel. The gate line 121 extends in a substantially horizontal direction. The gate line 121 includes a first gate electrode 124*a*, a second gate electrode 124*b*, and a third gate electrode 124*c*, protruded upward and extending from the gate line 121. The first gate electrode 124*a*, the second gate electrode 124*b*, and the third gate electrode 124*c* extend upward from the gate line 121, and are then expanded to reach the third gate electrode 124*c*, and then extend from the third gate electrode 124*c* to reach the first gate electrode 124*a* and the second gate electrode 124*b*. The first gate electrode 124*a* and the second gate electrode 124*b* may be formed in one expanded region. The gate line 121 may also include a curved portion that is periodically curved from a main line extended in the horizontal direction.

A gate insulating layer is formed on the gate line 121, and a first semiconductor 154*a*, a second semiconductor 154*b*, and a third semiconductor 154*c* are provided on each of the first gate electrode 124*a*, the second gate electrode 124*b*, and the third gate electrode 124*c*, respectively.

As shown in FIG. 2, a data conductor including a data line 171, a first drain electrode 175*a*, a second drain electrode 175*b*, a third source electrode 173*c*, a third drain electrode 175*c*, and a reference voltage line 178 are formed on the first semiconductor 154*a*, the second semiconductor 154*b*, the third semiconductor 154*c*, and the gate insulating layer.

The data line 171 extends in a substantially longitudinal direction, and includes a first source electrode 173*a* and a second source electrode 173*b* respectively extending toward the first and second gate electrodes 124*a* and 124*b*.

The reference voltage line 178 includes a main line 178*a* parallel to the data line 171, and a branch 178*b* extending from the main line 178*a* and approximately parallel to the gate line 121. The branch 178*b* extends along an outer region of the display area to a thin film transistor formation area (TA), and one end of the branch 178*b* forms the third drain electrode 175*c*.

The first drain electrode 175*a* faces the first source electrode 173*a*, the second drain electrode 175*b* faces the second source electrode 173*b*, and the third drain electrode 175*c* faces the third source electrode 173*c*. The third source electrode 173*c* is connected to the second drain electrode 175*b*.

The first gate electrode 124*a*, the first source electrode 173*a*, and the first drain electrode 175*a* form a first thin film transistor along with the first semiconductor 154*a*. The second gate electrode 124*b*, the second source electrode 173*b* and the second drain electrode 175*b* form a second thin film transistor along with the second semiconductor 154*b*. The third gate electrode 124*c*, the third source electrode 173*c*, and the third drain electrode 175*c* form a third thin film transistor along with the third semiconductor 154*c*. That is, the data voltage may be applied through the source electrodes of the first thin film transistor and the second thin film transistor. However, the reference voltage may be applied through the source electrode of the third thin film transistor.

A passivation layer may be positioned on the data conductor, and a pixel electrode may be positioned thereon. The pixel electrode provided in one pixel (PX) includes a high-gray pixel electrode 191*a* that is a pixel electrode of the high-gray subpixel (H sub), and a low-gray pixel electrode 191*b* that is a pixel electrode of the low-gray subpixel (L sub). One pixel electrode includes a high-gray pixel electrode 191*a* and a low-gray pixel electrode 191*b*.

The high-gray pixel electrode 191*a* and the low-gray pixel electrode 191*b* each include six unit pixel electrodes, each of unit pixel electrodes including a center electrode 198 and a plurality of minute branches 199 extended outward from a side of the center electrode 198. Each unit pixel electrode corresponds to a domain of the sub pixel.

The six unit pixel electrodes of the high-gray pixel electrode 191*a* and the low-gray pixel electrode 191*b* are arranged in series in the perpendicular direction and are connected to each other through an expansion.

Figure 3:
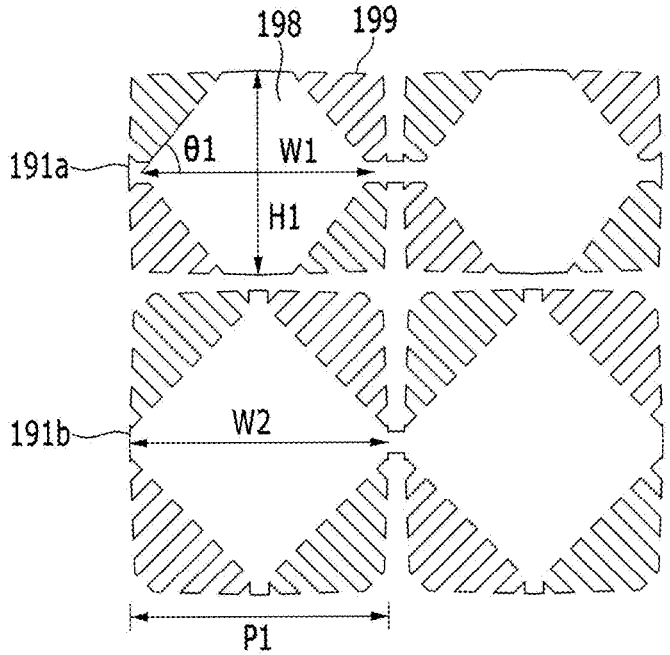
FIG. 3 shows a part of a pixel electrode of a liquid crystal display according to a present exemplary embodiment.
Figure 4:
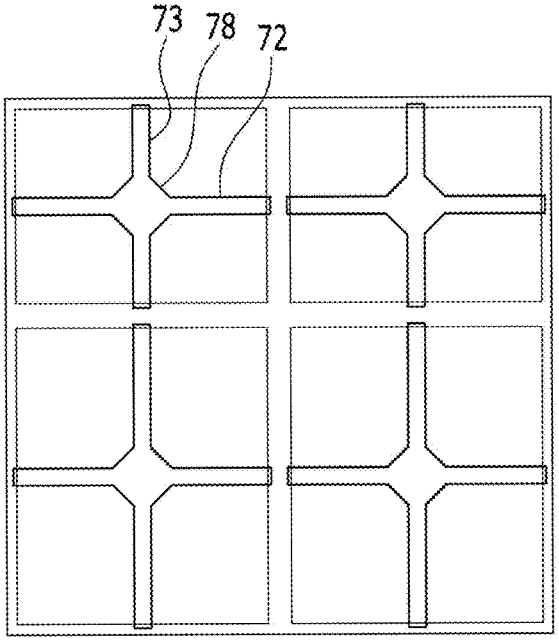
FIG. 4 shows a part of a common electrode of a liquid crystal display according to a present exemplary embodiment.

Forms of a high-gray pixel electrode and a low-gray pixel electrode according to the present exemplary embodiment will now be described with reference to FIG. 3 and FIG. 4. FIG. 3 shows a part of a pixel electrode of a liquid crystal display according to a present exemplary embodiment. FIG. 4 shows a part of a common electrode of a liquid crystal display according to a present exemplary embodiment.

Referring to FIG. 3, center electrodes 198 of a high-gray pixel electrode 191*a* and low-gray pixel electrode 191*b* according to the present exemplary embodiment have different forms. Likewise, a minute branch 199 of a high-gray pixel electrode 191*a* and low-gray pixel electrode 191*b* according to the present exemplary embodiment also have different forms.

Regarding the low-gray pixel electrode 191*b*, a horizontal width (W2) of the center electrode 198 corresponds to a width (P1) of one unit pixel electrode. However, regarding the high-gray pixel electrode 191*a*, a horizontal width (W1) of the center electrode 198 is narrower than the width (P1) of the one unit pixel electrode. Therefore, regarding the unit pixel electrode of the high-gray pixel electrode 191*a*, the minute branch 199 is longer.

That is, the horizontal length (W1) of the center electrode of the unit pixel electrode of the high-gray pixel electrode is shorter than the horizontal length W2 of the center electrode of the unit pixel electrode of the low-gray pixel electrode.

Differing from the present exemplary embodiment, when the horizontal width (W1) of the center electrode 198 of the high-gray pixel electrode 191*a* corresponds to the width (P1) of one unit pixel electrode, an angle (θ1) between one unit pixel electrode of the high-gray pixel electrode 191*a* and the base of the minute branch of the center electrode 198 becomes an angle that is less than 45 degrees. That is, when the horizontal lengths of the center electrodes of the low-gray pixel electrode and the high-gray pixel electrode each correspond with the width (P1) of one unit pixel electrode, the horizontal width (W1) of the center electrode 198 of the high-gray pixel electrode 191*a* is longer than the perpendicular height (H1) so the angle (θ1) between one unit pixel electrode of the high-gray pixel electrode 191*a* and the base of the minute branch of the center electrode 198 becomes an angle less than 45 degrees.

However, regarding the liquid crystal display according to the present exemplary embodiment, such as the one shown in FIG. 3, the horizontal width (W1) of the center electrode 198 of one unit pixel electrode of the high-gray pixel electrode 191*a* is equal to or shorter than the perpendicular height (H1) of the center electrode 198. The width of the center electrode 198 reduced in the horizontal manner is extended by the minute branch 199. Therefore, the horizontal width (W1) of the center electrode 198 of one unit pixel electrode of the high-gray pixel electrode 191*a* is equal to or shorter than the perpendicular width (H1). Thus, regarding one unit pixel electrode of the high-gray pixel electrode 191*a*, the angle (θ1) between the center electrode 198 and the base of the minute branch 199 is equal to or greater than 45 degrees.

The unit pixel electrode may be expanded from the center electrode 198 or the minute branch 199. Thus, the six unit pixel electrodes connected by the expansion receive the same voltage. The unit pixel electrodes belonging to the high-gray pixel electrode 191*a* and the low-gray pixel electrode 191*b* are mutually connected through the expansion, and are separated from the unit pixel electrode belonging to other pixel electrodes. That is, the unit pixel electrodes belonging to the high-gray pixel electrode 191*a* are separated from those belonging to the low-gray pixel electrode 191*b*.

The first drain electrode 175*a* of the first thin film transistor is connected to the high-gray pixel electrode 191*a* through a first contact hole 185*a*. In FIG. 2, the first connector 195*a* connects the first drain electrode 175*a* to the high-gray pixel electrode 191*a*.

The second drain electrode 175*b* of the second thin film transistor is connected to the low-gray pixel electrode 191*b* through a second contact hole 185*b*. In FIG. 2, the second drain electrode 175*b* is connected to the low-gray pixel electrode 191*b* through the second connector 195*b*. The third thin film transistor connects the second drain electrode 175*b* of the second thin film transistor and the reference voltage line 178 to change a level of a data voltage applied to the low-gray pixel electrode 191*b*.

Regarding an upper panel, a common electrode facing the pixel electrode and receiving the common voltage (Vcom) may be provided on the insulation substrate.

Referring to FIG. 4, openings 72, 73, and 78 are formed in an upper common electrode of one domain region in which the unit pixel electrodes 198 and 199 are provided. That is, a cross-shaped opening, including a horizontal opening 72 and a perpendicular opening 73 crossing horizontal opening 72, is formed on the upper common electrode. The present exemplary embodiment includes a center opening 78 provided in a center of the cross-shaped opening. The center opening 78 has a polygonal configuration including four linear sides provided in four subregions divided by the cross-shaped opening. That is, the center opening 78 has a rhombus shape in the present exemplary embodiment. The openings 72, 73, and 78 that correspond to neighboring unit pixel electrodes are not connected to each other in the present exemplary embodiment. However, depending on need, all neighboring openings 72, 73, and 78 may be connected to each other. Additionally, depending on need, a protrusion may be formed instead of the opening of the common electrode as a domain dividing means.

A liquid crystal layer provided between a lower panel and an upper panel may include liquid crystal molecules having negative dielectric anisotropy. The liquid crystal molecules may be aligned such that a long axis may be perpendicular to the surfaces of the two display panels while there is no electric field.

When the data voltage is transmitted to the pixel (PX), the data voltage is applied to the high-gray pixel electrode 191*a* through a first thin film transistor. On the contrary, an intermediate voltage of the data voltage applied through a second thin film transistor and a reference voltage transmitted through a third thin film transistor are applied to two low-gray pixel electrodes 191*b*. As a result, voltages with different levels are applied to the high-gray pixel electrode 191*a* and the two low-gray pixel electrodes 191*b*.

The high-gray and low-gray pixel electrodes 191*a* and 191*b*, to which the data voltages with different levels are applied, and the common electrode of the upper panel generate an electric field to the liquid crystal layer. The electric field may determine a direction of the liquid crystal molecules of the liquid crystal layer between the two electrodes. In this instance, a direction in which the liquid crystal molecules are slanted may be determined by a horizontal component that is generated by distorting a main electric field substantially perpendicular to a surface of the display panel, and a side of an opening in the common electrode. The distortion in the main electric field may be caused by a gap in which the pixel electrode is not provided. The horizontal component of the main electric field is substantially perpendicular to the unit pixel electrodes 198 and 199 and the sides of the openings 72, 73, and 78. Thus, the liquid crystal molecules are slanted in a direction that is substantially perpendicular to the sides of the openings 72, 73, and 78.

When the high-gray pixel electrode 191*a* and the low-gray pixel electrode 191*b* are disposed next to one another in a vertical direction, as shown in FIG. 2, the reference voltage line 178 is disposed perpendicularly through the center of the high-gray pixel electrode 191*a* and the low-gray pixel electrode 191*b*, and, thus, has a symmetrical structure.

Figure 5:
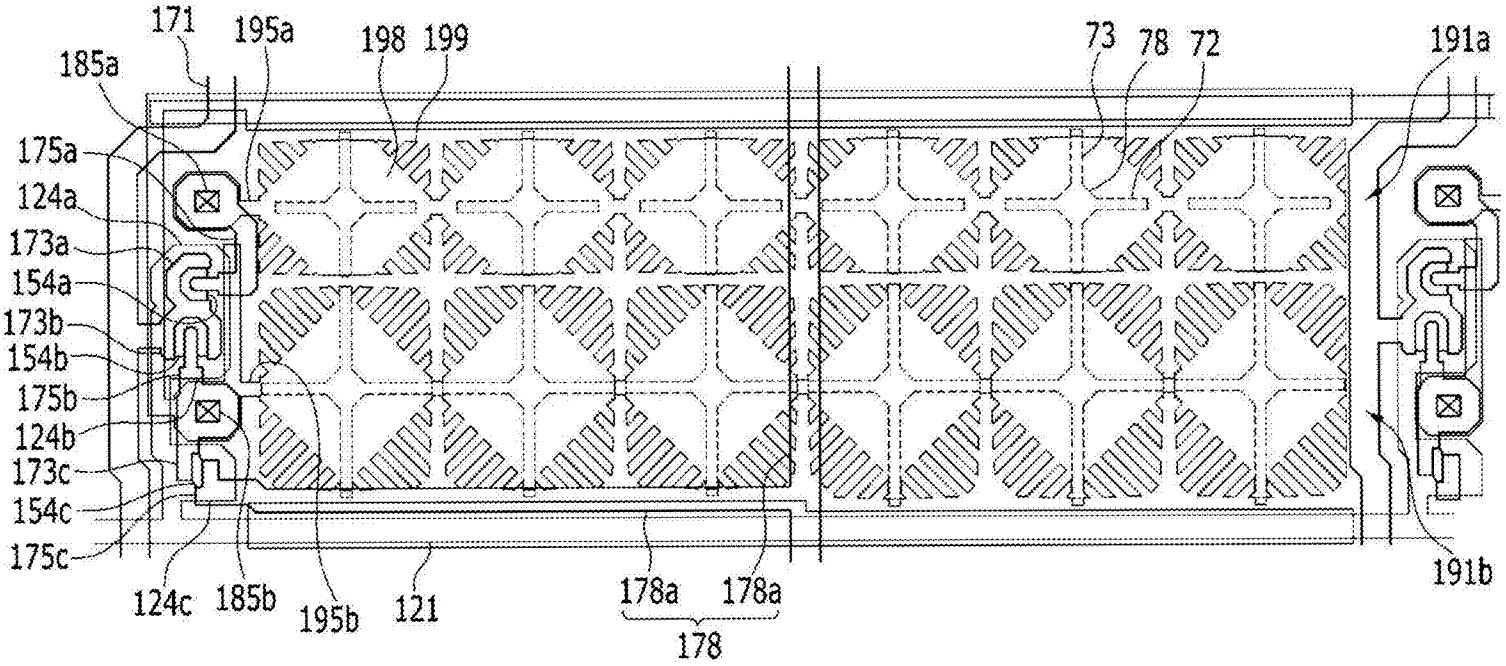
FIG. 5 shows a detailed configuration of a pixel according to an exemplary embodiment of the present invention.
Figure 6:
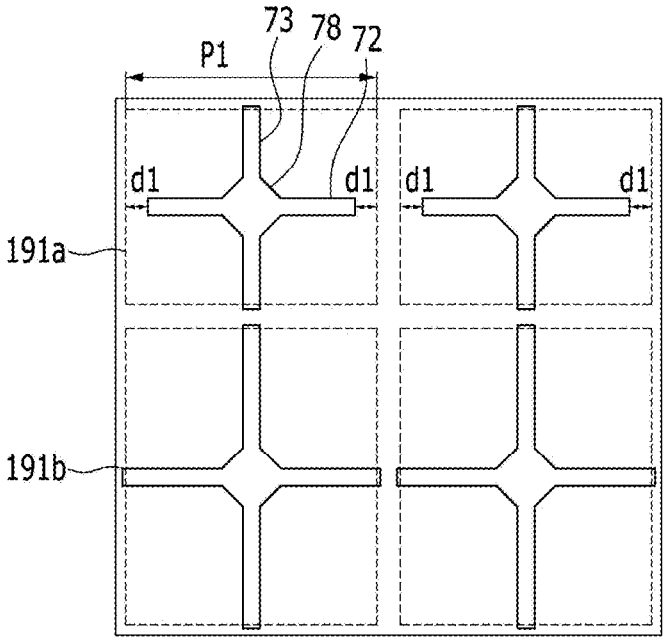
FIG. 6 shows a part of a common electrode of a liquid crystal display according to a present exemplary embodiment.

A liquid crystal display according to an exemplary embodiment of the present invention will now be described with reference to FIG. 5 and FIG. 6. FIG. 5 shows a detailed configuration of a pixel according to an exemplary embodiment of the present invention. FIG. 6 shows a part of a common electrode of a liquid crystal display according to a present exemplary embodiment.

Referring to FIG. 5 and FIG. 6, the liquid crystal display is similar to the liquid crystal display according to the exemplary embodiment shown in FIG. 2 to FIG. 4. Detailed descriptions on the similar constituent elements will be omitted.

However, regarding the liquid crystal display according to the present exemplary embodiment, a shape of the horizontal opening 72 of the common electrode facing the high-gray pixel electrode 191*a* is different from a shape of the horizontal opening 72 of the common electrode facing the low-gray pixel electrode 191*b*.

Referring to FIG. 6, the horizontal opening in the common electrode facing the unit pixel electrode of the high-gray pixel electrode is shorter than the horizontal opening in the common electrode facing the unit pixel electrode of the low-gray pixel electrode.

Referring to FIG. 6, the horizontal opening 72 in the common electrode facing the high-gray pixel electrode 191*a* is reduced by D1 from respective sides, compared to the horizontal length (P1) of the region 191*a* occupied by the high-gray pixel electrode. On the contrary, the horizontal opening 72 in the common electrode facing the low-gray pixel electrode 191*b* is formed to have the same width as the horizontal area (P1) occupied by the low-gray pixel electrode. However, the horizontal opening 72 in the common electrode facing the high-gray pixel electrode 191*a* is reduced by D1 from respective sides compared to the horizontal width of the high-gray pixel electrode. Therefore, the horizontal opening 72 of the common electrode facing the high-gray pixel electrode 191*a* is shorter by D1*2 than the horizontal opening in the common electrode facing the low-gray pixel electrode 191*b*. Reduction of the length of the horizontal opening 72 may be performed in the entire common electrode region that corresponds to the high-gray pixel electrode 191*a*. Therefore, when the high-gray pixel electrode 191*a* is configured with six unit pixel electrodes, right and left widths of each of the six horizontal openings 72 of the common electrode corresponding to the six unit pixel electrodes are reduced.

In this instance, the reduced length D1 may be from 5 um to 9 um. For example, in the liquid crystal display according to the exemplary embodiment of the present invention, D1 is set to be 6 um or 8 um. However, the length of D1 is not restricted thereto.

Figure 7:
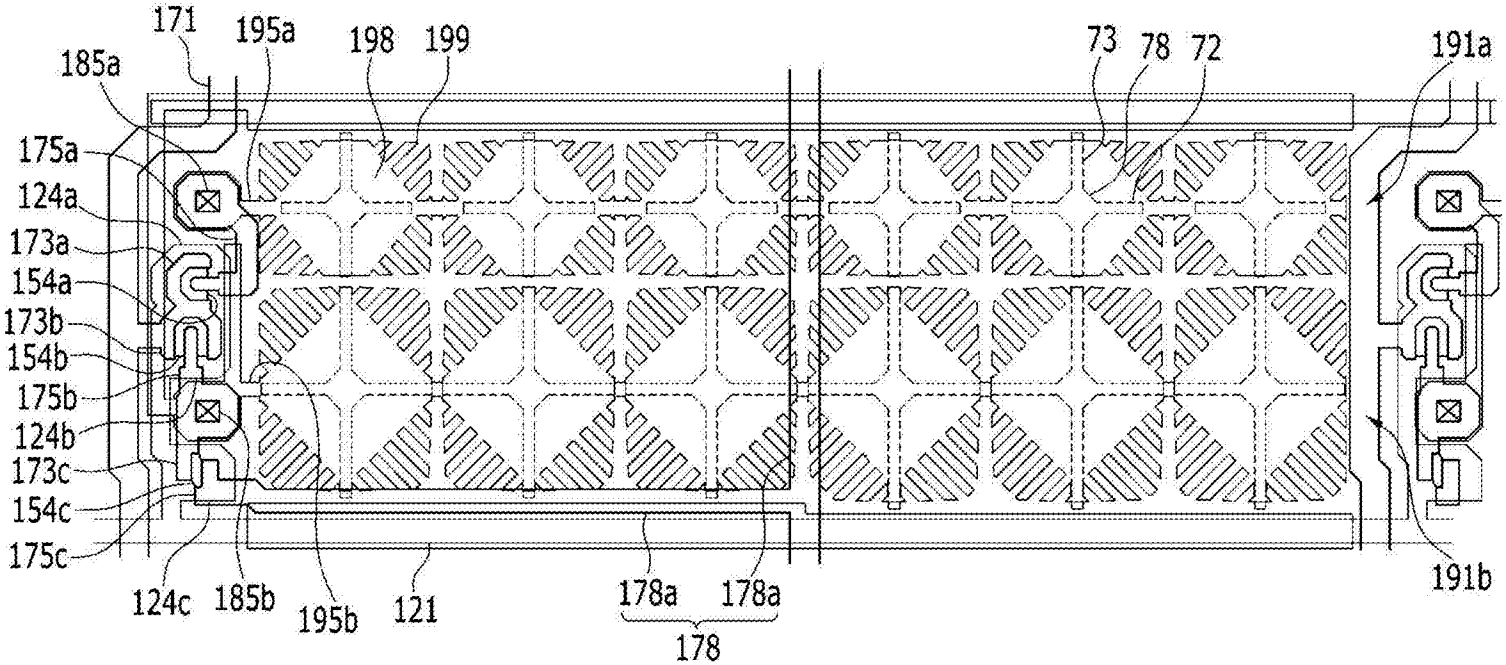
FIG. 7 shows a detailed configuration of a pixel according to the other exemplary embodiment of the present invention.
Figure 8:
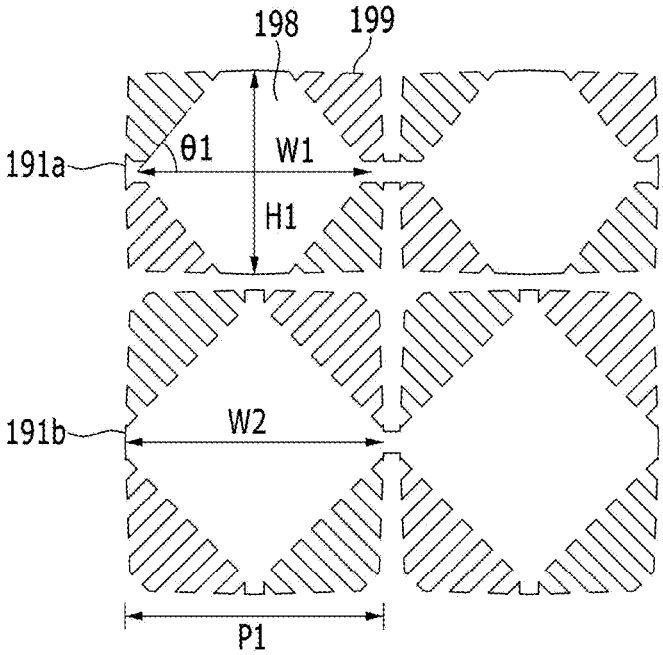
FIG. 8 shows a part of a pixel electrode of a liquid crystal display according to a present exemplary embodiment.
Figure 9:
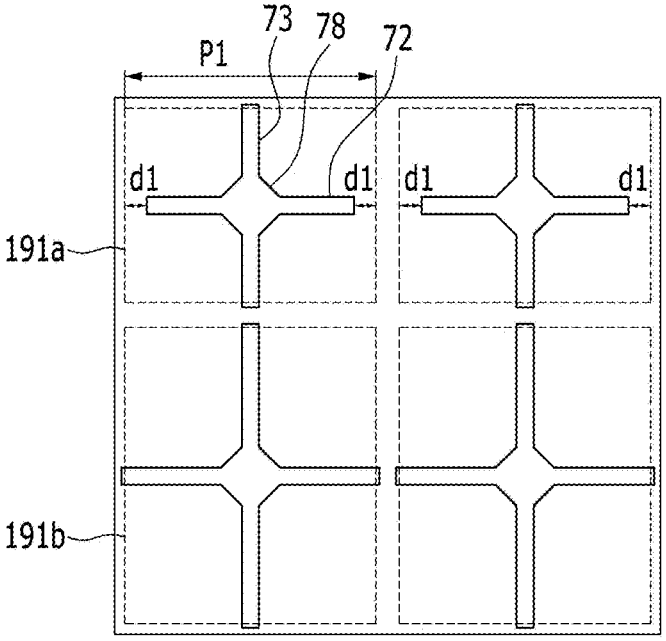
FIG. 9 shows a part of a common electrode of a liquid crystal display according to a present exemplary embodiment.

A liquid crystal display according to an exemplary embodiment of the present invention will now be described with reference to FIG. 7 to FIG. 9. FIG. 7 shows a detailed configuration of a pixel according to an exemplary embodiment of the present invention. FIG. 8 shows a part of a pixel electrode of a liquid crystal display according to a present exemplary embodiment. FIG. 9 shows a part of a common electrode of a liquid crystal display according to a present exemplary embodiment.

Referring to FIG. 7 to FIG. 9, the liquid crystal display according to the present exemplary embodiment is similar to the liquid crystal display according to the exemplary embodiment shown in FIG. 2 to FIG. 4. Detailed descriptions of the similar constituent elements will be omitted.

However, in the liquid crystal display according to the present exemplary embodiment, the horizontal width (W1) of the center electrode 198 of the high-gray pixel electrode 191*a* is narrower than the width (P1) of the unit pixel electrode. Further, the horizontal opening 72 of the common electrode facing the high-gray pixel electrode 191*a* is reduced by D1 from respective sides compared to the horizontal length (P1) of the region 191*a* occupied by the high-gray pixel electrode.

Referring to FIG. 8, the horizontal width (W1) of the center electrode 198 of one unit pixel electrode of the high-gray pixel electrode 191*a* is narrower than the width (P1) of one unit pixel electrode. Conversely, the horizontal width (W2) of the center electrode 198 of one unit pixel electrode of the low-gray pixel electrode 191*b* is equal to the width (P1) of one unit pixel electrode.

The horizontal width (W1) of the center electrode 198 of one unit pixel electrode of the high-gray pixel electrode 191*a* is equal to or shorter than the perpendicular width (H1) of the center electrode 198. The length of the center electrode 198 reduced in the horizontal manner is extended to the minute branch 199.

That is, the horizontal width (W1) of the center electrode 198 of one unit pixel electrode of the high-gray pixel electrode 191*a* is equal to or shorter than the perpendicular height (H1). Thus, regarding one unit pixel electrode of the high-gray pixel electrode 191*a*, the angle (θ1) between the center electrode 198 and the base of the minute branch 199 becomes equal to or greater than 45 degrees.

Regarding the liquid crystal display according to the present exemplary embodiment, a shape of the horizontal opening 72 of the common electrode facing the high-gray pixel electrode 191*a* is different from a shape of the horizontal opening 72 of the common electrode facing the low-gray pixel electrode 191*b*.

Referring to FIG. 9, the horizontal opening of the common electrode facing the unit pixel electrode of the high-gray pixel electrode is shorter than the horizontal opening of the common electrode facing the unit pixel electrode of the low-gray pixel electrode.

The horizontal opening 72 of the common electrode facing the high-gray pixel electrode 191*a* is reduced by D1 from respective sides, compared to the horizontal length (P1) of the region 191*a* occupied by the high-gray pixel electrode. The horizontal opening 72 of the common electrode facing the low-gray pixel electrode 191*b* is formed to have a same width as the horizontal area (P1) occupied by the low-gray pixel electrode. However, the horizontal opening 72 of the common electrode facing the high-gray pixel electrode 191*a* is reduced by D1 from respective sides compared to the horizontal width occupied by the high-gray pixel electrode. Therefore, the horizontal opening 72 of the common electrode facing the high-gray pixel electrode 191*a* becomes shorter by D1*2 than the horizontal opening of the common electrode facing the low-gray pixel electrode 191*b*. Reduction of the length of the horizontal opening 72 may be performed in the entire common electrode region that corresponds to the high-gray pixel electrode 191*a*.

Thus, when the high-gray pixel electrode 191*a* is configured with six unit pixel electrodes, right and left widths of the six horizontal openings 72 of the common electrode corresponding to the six unit pixel electrodes are reduced.

Figure 10:
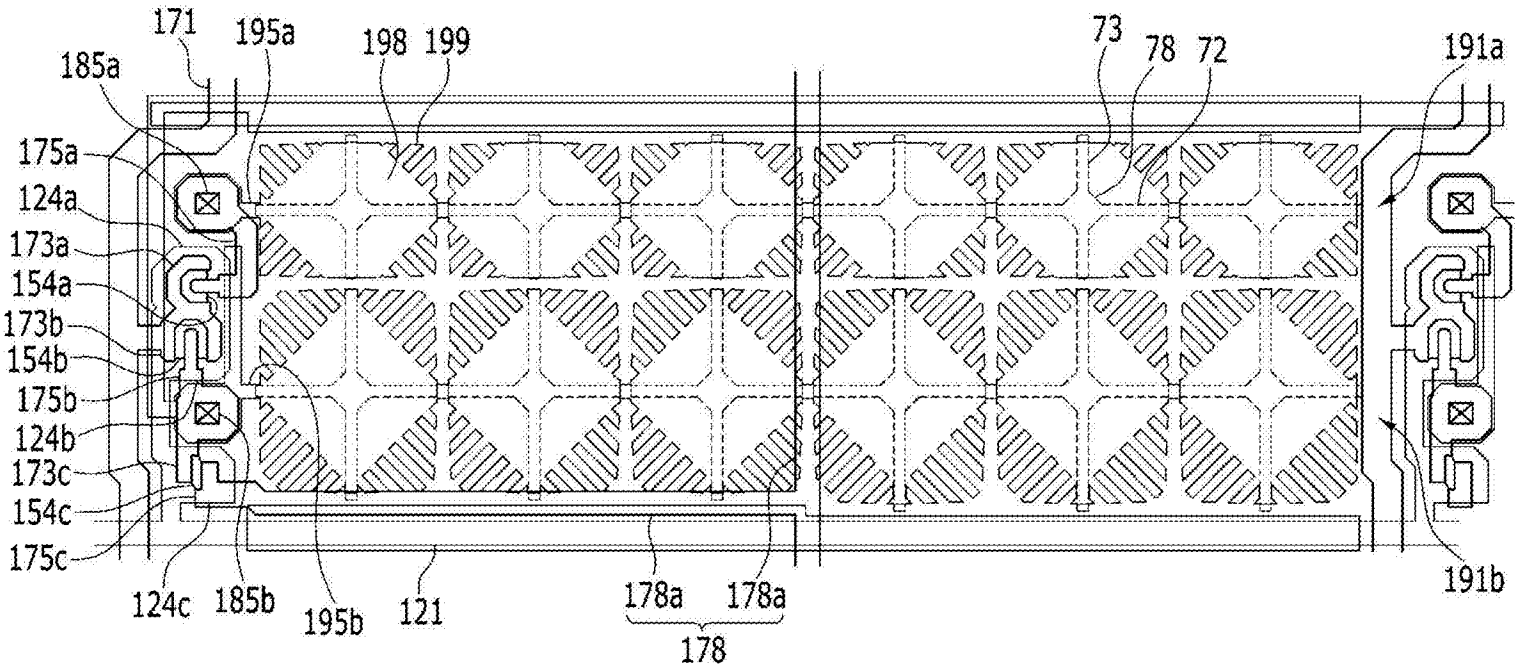
FIG. 10 shows a detailed configuration of a pixel according to a comparative example of the present invention.
Figure 11:
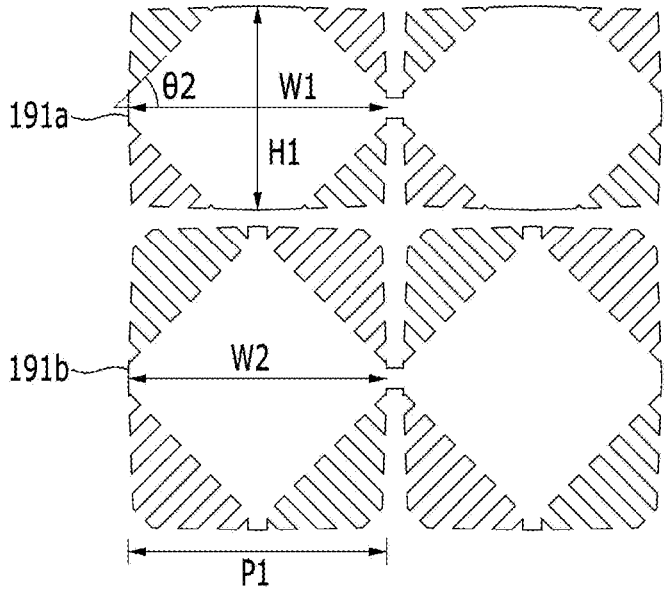
FIG. 11 shows a part of a pixel electrode of a liquid crystal display according to a comparative example of the present invention.
Figure 12:
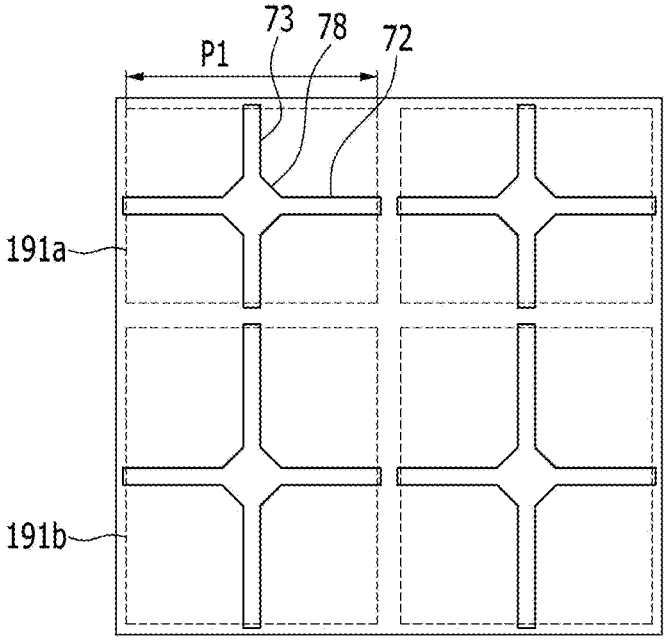
FIG. 12 shows a part of a common electrode of a liquid crystal display according to a comparative example of the present invention.

FIG. 10 shows a detailed configuration of a pixel according to a comparative example of the present invention. FIG. 11 shows a part of a pixel electrode of a liquid crystal display according to a comparative example of the present invention. FIG. 12 shows a part of a common electrode of a liquid crystal display according to a comparative example of the present invention.

Referring to FIG. 11, regarding the pixel electrode of the liquid crystal display according to the comparative example of the present invention, the width (W1) of the center electrode 198 of the high-gray pixel electrode 191*a* is equal to the width (P1) of one unit pixel electrode.

Therefore, regarding the liquid crystal display according to the comparative example of the present invention, the horizontal width (W1) of the center electrode 198 of one unit pixel electrode of the high-gray pixel electrode 191*a* is longer than the perpendicular width (H1) of the center electrode 198. Therefore, an angle (θ2) between the center electrode 198 of one unit pixel electrode of the high-gray pixel electrode 191*a* and the base of the minute branch is less than 45 degrees.

Referring to FIG. 12, the length of the horizontal opening 72 of the common electrode that corresponds to the high-gray pixel electrode and the low-gray pixel electrode of the liquid crystal display according to the present comparative example is equal to the width (P1) of one unit pixel electrode. That is, through the entire common electrode, the length of the horizontal opening 72 is provided as P1, and the lengths of the horizontal openings 72 are not different for the common electrodes that correspond to the high-gray pixel electrode and the low-gray pixel electrode.

Figure 13:
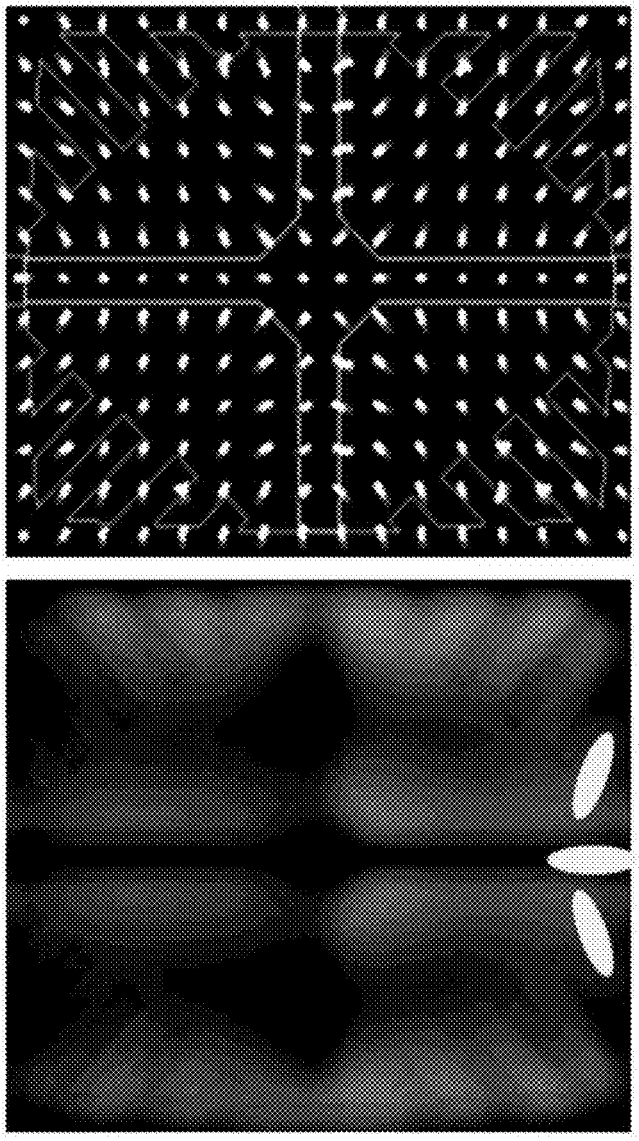
FIG. 13 shows a unit high-gray pixel electrode, a common electrode, and a liquid crystal alignment state of a liquid crystal display according to a comparative example of the present invention.
Figure 14:
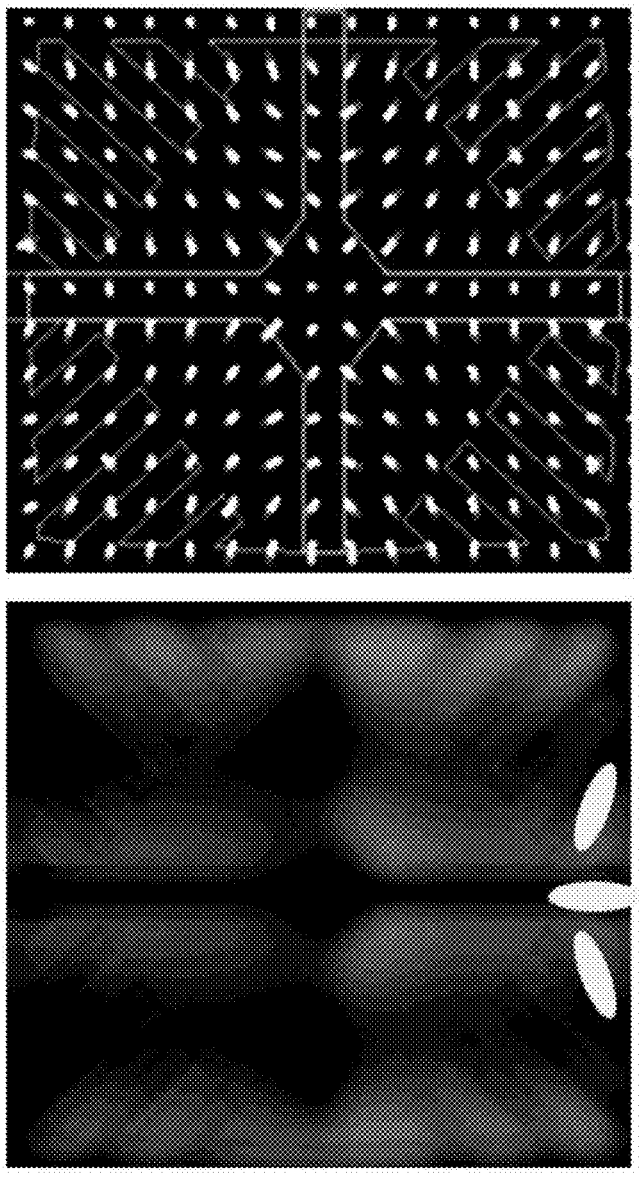
FIG. 14 shows a unit high-gray pixel electrode, a common electrode, and a liquid crystal alignment state of a liquid crystal display according to an exemplary embodiment of the present invention.
Figure 15:
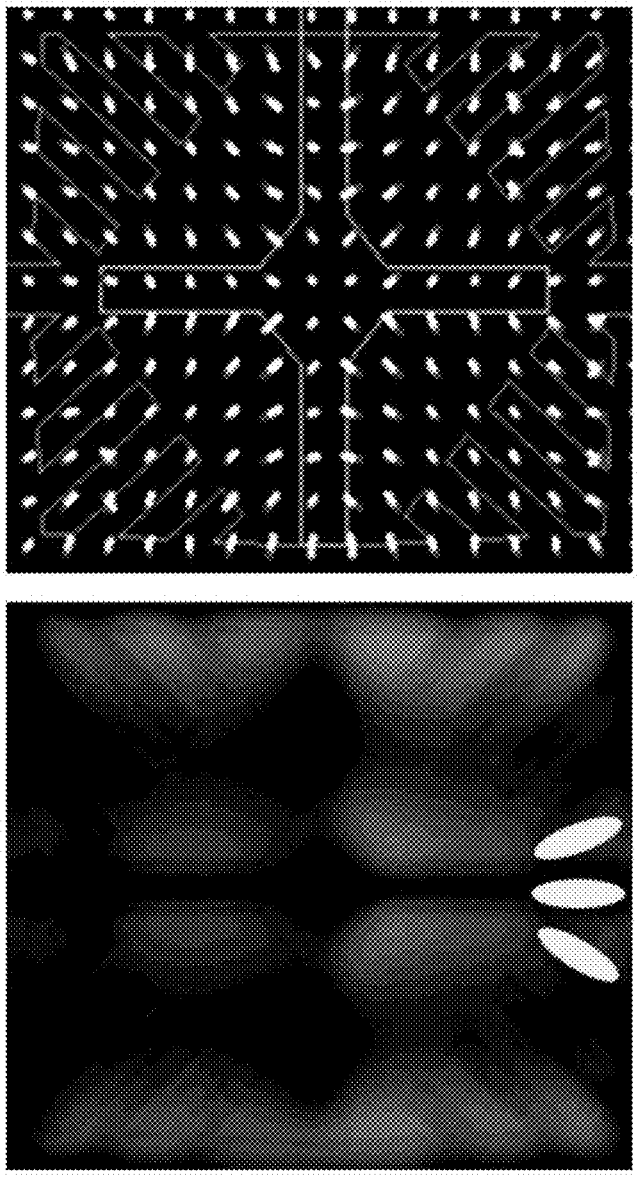
FIG. 15 shows a unit high-gray pixel electrode, a common electrode, and a liquid crystal alignment state of a liquid crystal display according to an exemplary embodiment of the present invention.

An effect of a liquid crystal display according to an exemplary embodiment of the present invention will now be described with reference to FIG. 13 to FIG. 15. FIG. 13 shows a unit high-gray pixel electrode, a common electrode, and a liquid crystal alignment state of a liquid crystal display according to a comparative example of the present invention. FIG. 14 shows a unit high-gray pixel electrode, a common electrode, and a liquid crystal alignment state of a liquid crystal display according to an exemplary embodiment of the present invention. FIG. 15 shows a unit high-gray pixel electrode, a common electrode, and a liquid crystal alignment state of a liquid crystal display according to an exemplary embodiment of the present invention.

FIG. 13 corresponds to a comparative example (hereinafter, Ref) shown in FIG. 10 to FIG. 12; FIG. 14 corresponds to an exemplary embodiment (hereinafter, SP1) shown in FIG. 2 to FIG. 4, which is an embodiment of the present invention; and FIG. 15 corresponds to an exemplary embodiment (hereinafter, SP3) shown in FIG. 7 to FIG. 9, which is another embodiment of the present invention.

In the liquid crystal display according to the comparative example and the exemplary embodiments, the shapes of the common electrode and the pixel electrode in the high-gray pixel area will be summarized as below.

TABLE 1

| Drawing number | High-gray pixel electrode | Common electrode |
|---|---|---|
| FIG. 13 (Ref) | Width of center electrode of pixel electrode, = Horizontal width of unit pixel electrode | Length of horizontal opening = Horizontal width of unit pixel electrode |
| FIG. 14 (Sp1) | Width of center electrode of pixel electrode < Horizontal width of unit pixel electrode | Length of horizontal opening = Horizontal width of unit pixel electrode |
| FIG. 15 (Sp3) | Width of center electrode of pixel electrode < Horizontal width of unit pixel electrode | Length of horizontal opening < Horizontal width of unit pixel electrode |

Referring to FIG. 13, the horizontal width of the center electrode of one high-gray unit pixel electrode is longer than the perpendicular width of the center electrode. The length of the horizontal opening of the common electrode is also longer than the perpendicular opening.

Therefore, a control force to control the liquid crystal vertically is greater than a control force to arrange the liquid crystal horizontally. When the control force to control liquid crystal vertically is strong, the liquid crystal is arranged with an angle greater than 45 degrees, and when the control force to arrange the liquid crystal horizontally becomes great, the liquid crystal is arranged with an angle less than 45 degrees. Particularly, the control force to control the liquid crystal vertically becomes greater at an edge of one unit pixel electrode. Therefore, as shown in FIG. 13, the liquid crystal is arranged with an angle greater with respect to the horizontal opening near an end of the horizontal opening.

When the liquid crystal is arranged with an angle greater than 45 degrees, retardation is increased on the side and gamma lifting appears in the low-gray. Therefore, visibility is weakened.

However, in exemplary embodiments of the present invention, the liquid crystal display appropriately changes the shape of one or both the pixel electrode and the common electrode in the high-gray region to reduce the vertical control force to control the liquid crystal. Therefore, the liquid crystal is not arranged with an angle greater than 45 degrees and the gamma lifting phenomenon in the low gray is improved.

FIG. 14 shows an experimental result of a liquid crystal display having a deformed pixel electrode. In FIG. 14, the horizontal width of the center electrode of the pixel electrode is reduced to be shorter than the width of one unit pixel electrode. That is, FIG. 14 shows the experimental result about the liquid crystal display according to the exemplary embodiment shown in FIG. 2 to FIG. 4.

Referring to FIG. 14, the horizontal width of the center electrode of the pixel electrode is reduced from both its ends to be shorter than the width of one pixel electrode. The control force for controlling the liquid crystal vertically is also reduced. Therefore, while the liquid crystal according to the comparative example shown in FIG. 13 is arranged with an angle greater than 45 degrees, the control force to control the liquid crystal vertically is slightly reduced and an arrangement angle of the liquid crystal is slightly reduced in the liquid crystal display according to the present exemplary embodiment. The angle reduction is particularly noticeable in both end regions of the horizontal opening.

Thus, comparing images at lower sides of FIG. 13 and FIG. 14, FIG. 14, the exemplary embodiment of the present invention, looks darker than FIG. 13, the comparative example of the present invention. That is, regarding FIG. 14, the horizontal width of the center electrode of the pixel electrode is reduced to decrease the vertical control force of liquid crystal and improves the gamma lifting problem in the low gray region.

FIG. 15 shows an experimental result of a liquid crystal display having deformed the pixel electrode and the common electrode. In FIG. 15, the horizontal width of the center electrode of the pixel electrode is reduced to be shorter than the width of one unit pixel electrode, and the length of the horizontal opening of the common electrode is reduced to be shorter than the width of one unit pixel electrode.

Therefore, the vertical direction control force on the liquid crystal is reduced compared to the comparative case of FIG. 13, and the vertical direction control force on the liquid crystal is reduced compared to the case of FIG. 14. Referring to FIG. 15, it is found that the liquid crystal molecules that are near the horizontal opening are arranged with an angle less than 45 degrees. Hence, the gamma lifting in the low gray induced by an arrangement of the liquid crystal molecules with an angle greater than 45 degrees is substantially improved.

This can also be found with the image at the bottom of FIG. 15. When compared to FIG. 13 (Ref), the image of FIG. 15 looks darker, and when compared to FIG. 14 (Sp1), the image of FIG. 15 looks darker.

That is, in FIG. 15, the liquid crystal molecules are arranged with an angle less than 45 degrees for the common electrode horizontal opening, thereby improving the lateral low-gray lifting phenomenon caused by the arrangement of liquid crystal molecules with an angle greater than 45 degrees.

An exemplary embodiment of the present invention therefore reduces the vertical control force of liquid crystal molecules and arranges the liquid crystal molecules with an angle less than 45 degrees by appropriately deforming one or both of the pixel electrode and the common electrode in the high gray region. Thus, the lateral low-gray lifting phenomenon induced by the arrangement of the liquid crystal molecules with an angle greater than 45 degrees is improved and lateral visibility is likewise improved.

Figure 16:
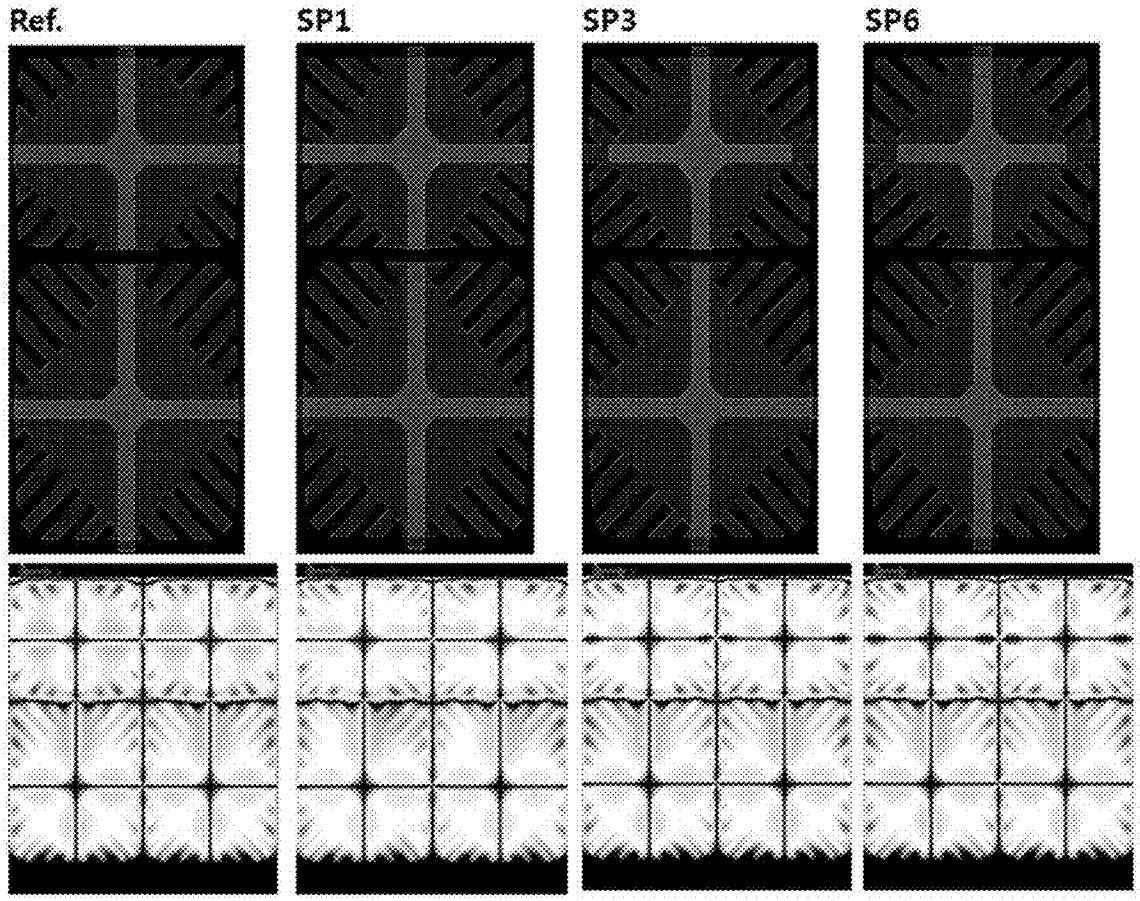
FIG. 16 shows a form of a pixel electrode according to a comparative example and an exemplary embodiment of the present invention, and an image of actually measured luminance.

FIG. 16 shows a pixel electrode according to a comparative example and an exemplary embodiment of the present invention, and an image of actually measured luminance.

Figure 17:
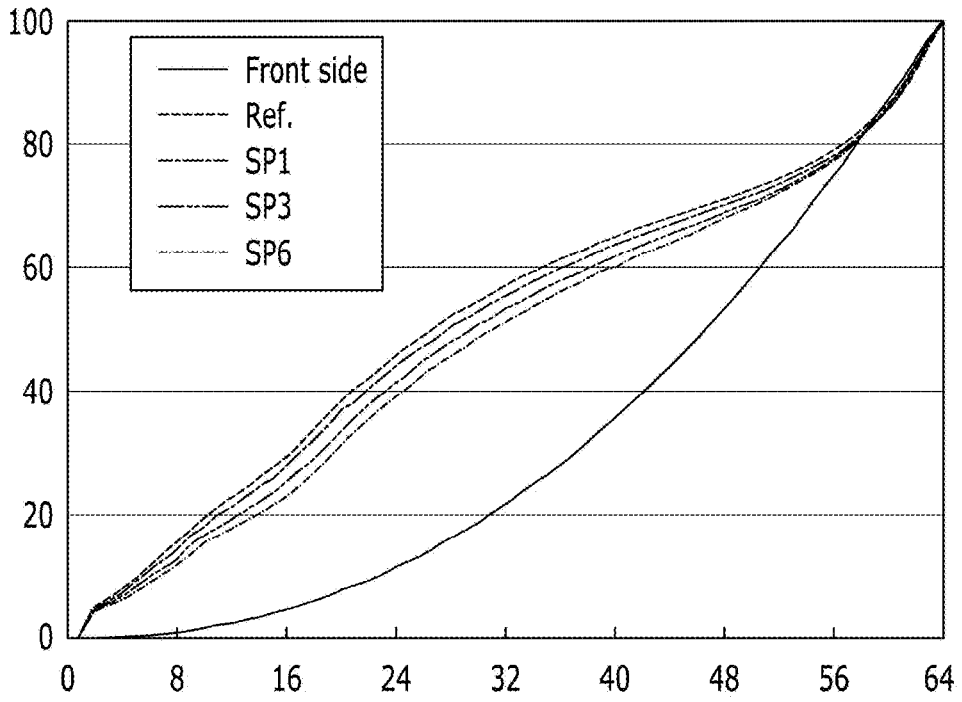
FIG. 17 shows a gamma curve of a liquid crystal display according to a comparative example and an exemplary embodiment of FIG. 16.

FIG. 17 shows a gamma curve of a liquid crystal display according to a comparative example and an exemplary embodiment of FIG. 16.

Shapes of the pixel electrode and the common electrode of Ref, SP1, SP3, and SP6 shown in FIG. 16 are as follows.

TABLE 2

| Number | High-gray pixel electrode | Common electrode |
|---|---|---|
| Ref (Comparative Example) | Width of center electrode of pixel electrode = Horizontal width of pixel electrode | Length of horizontal opening = Horizontal width of pixel electrode |
| Sp1 (Exemplary Embodiment 1) | Width of center electrode of pixel electrode < Horizontal width of pixel electrode | Length of horizontal opening = Horizontal width of pixel electrode |
| Sp3 (Exemplary Embodiment 2) | Width of center electrode of pixel electrode < Horizontal width of pixel electrode | Reduction of horizontal opening to left and right by 6 um respectively |
| Sp6 (Exemplary Embodiment 3) | Width of center electrode of pixel electrode < Horizontal width of pixel electrode | Reduction of horizontal opening to left and right by 9 um respectively |

FIG. 17 shows measurement of a gamma curve according to a comparative example and an exemplary embodiment based on an image of FIG. 16. Referring to FIG. 17, the comparative example of Ref generates the most severe lifting phenomenon, and is found to be the most distant from the curve showing the front side. On the contrary, exemplary embodiments of the present invention Sp1, Sp3, and Sp6, show that the gamma curve is the nearer to the gamma curve in the front compared to Ref. Particularly, it is determined that they were close to the gamma curve in the front in an order of Sp1<Sp3<Sp6. That is, it is found that the visibility is improved in the order of Sp1<Sp3<Sp6.

Figure 18:
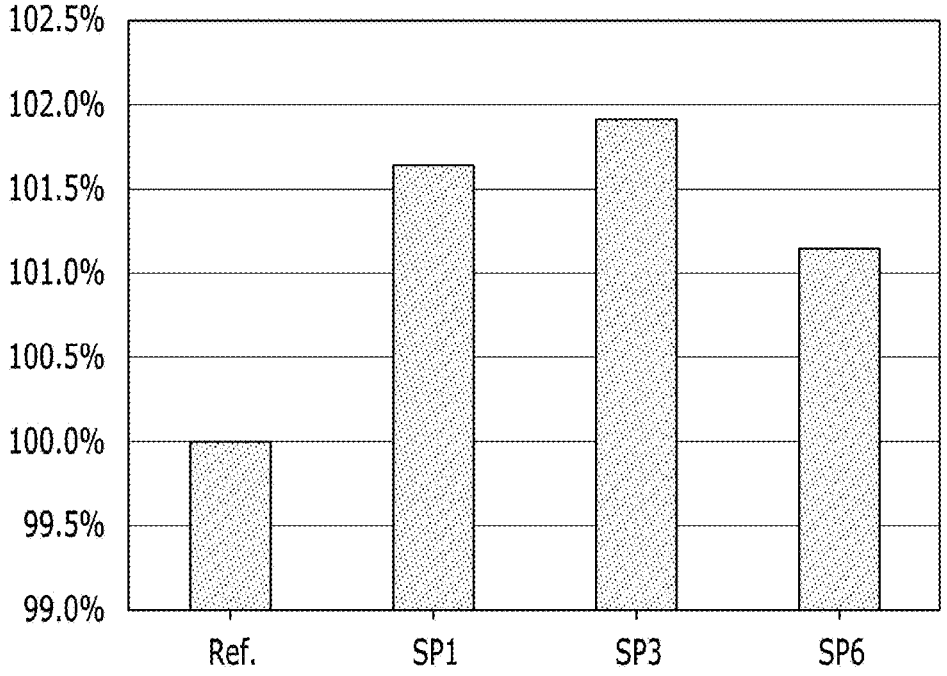
FIG. 18 shows a result of measuring transmittance of a liquid crystal display according to a comparative example and an exemplary embodiment of the present invention.

FIG. 18 shows a result of measuring transmittance of a liquid crystal display according to comparative example and exemplary embodiments of the present invention. Conventionally, visibility and transmittance have a reverse reciprocal characteristic so transmittance is deteriorated when visibility is improved.

Referring to FIG. 18, transmittance of the exemplary embodiments Sp1, Sp3, and Sp6 with better visibility is shown to be greater than the transmittance of the comparative example (Ref) with worse visibility. That is, the liquid crystal display having a pixel configuration according to the embodiment of the present invention improves transmittance as well as visibility.

Figure 19:
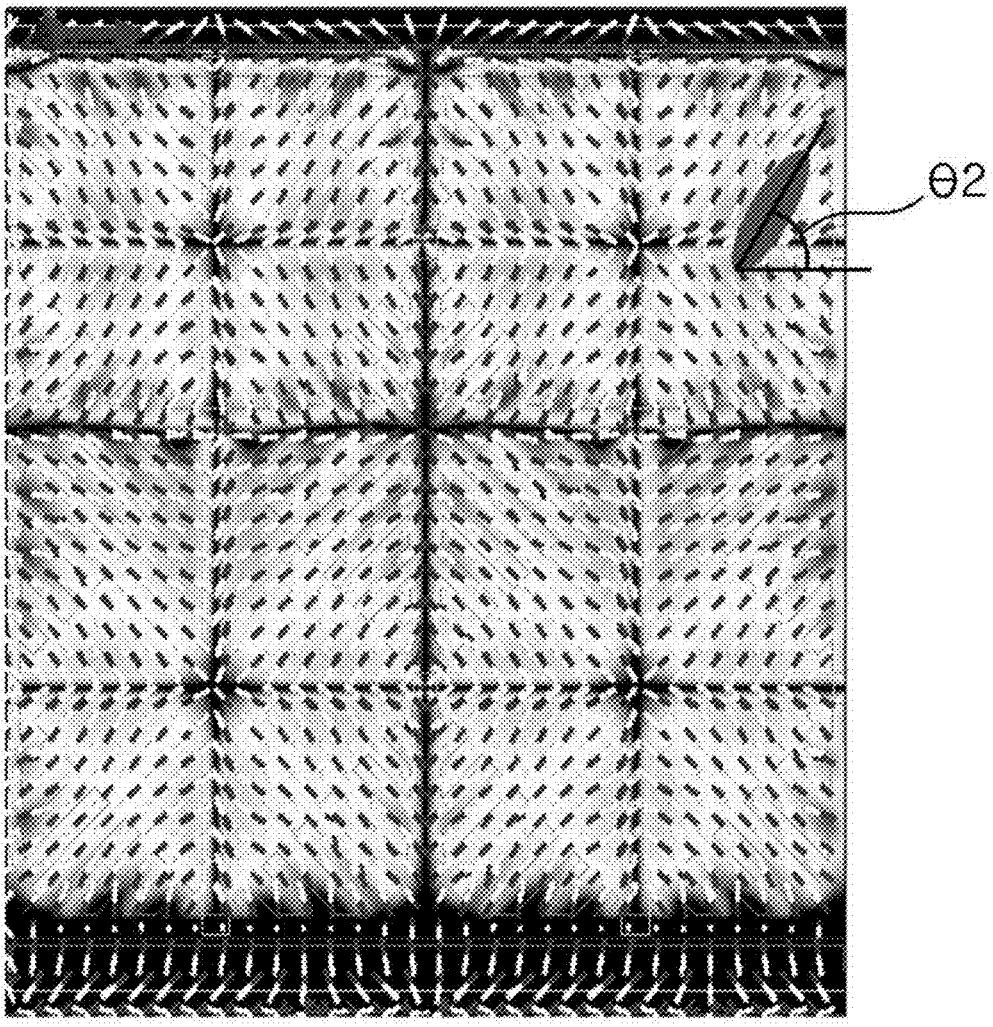
FIG. 19 shows a pixel configuration and a liquid crystal arrangement state of a liquid crystal display according to a comparative example.
Figure 20:
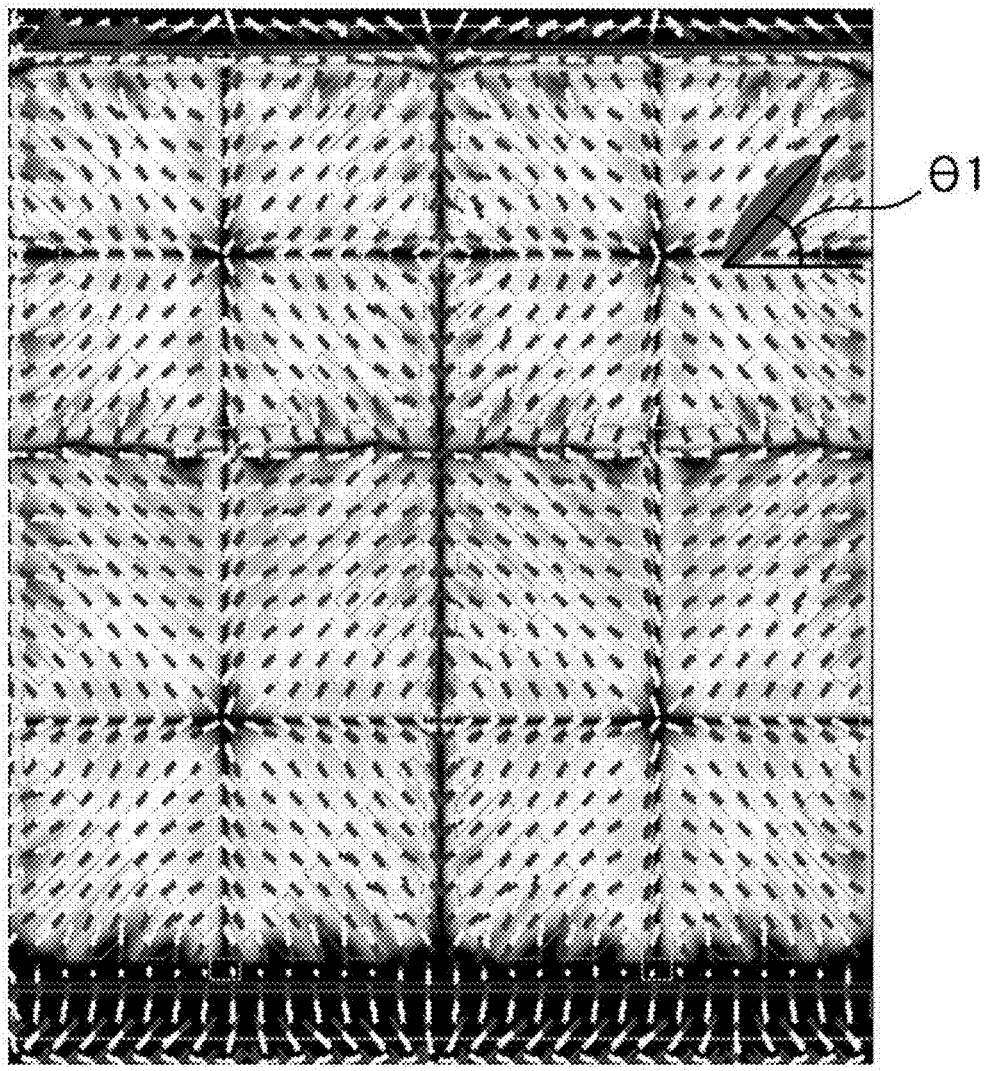
FIG. 20 shows a pixel configuration and a liquid crystal arrangement state of a liquid crystal display according to an exemplary embodiment (Sp3) of the present invention.

A reason why the transmittance according to the exemplary embodiment of the present invention is better than that of the comparative example will now be described with reference to FIG. 19 and FIG. 20. FIG. 19 shows a pixel configuration and a liquid crystal arrangement state of a liquid crystal display according to a comparative example, and FIG. 20 shows a pixel configuration and a liquid crystal arrangement state of a liquid crystal display according to an exemplary embodiment (Sp3) of the present invention. Referring to FIG. 19, regarding the liquid crystal display according to the comparative example, an arrangement angle (θ2) of the liquid crystal molecules that are near the common electrode horizontal opening is an angle greater than 45 degrees. Referring to FIG. 20, regarding the liquid crystal display according to the embodiment of the present invention, an arrangement angle (θ1) of the liquid crystal molecules that are near the common electrode horizontal opening is equal or close to 45 degrees. Therefore, when the length of the common electrode horizontal opening and the width of the center electrode of the pixel electrode are reduced, the liquid crystal molecules are arranged to be close to 45 degrees so transmittance is increased.

Figure 21:
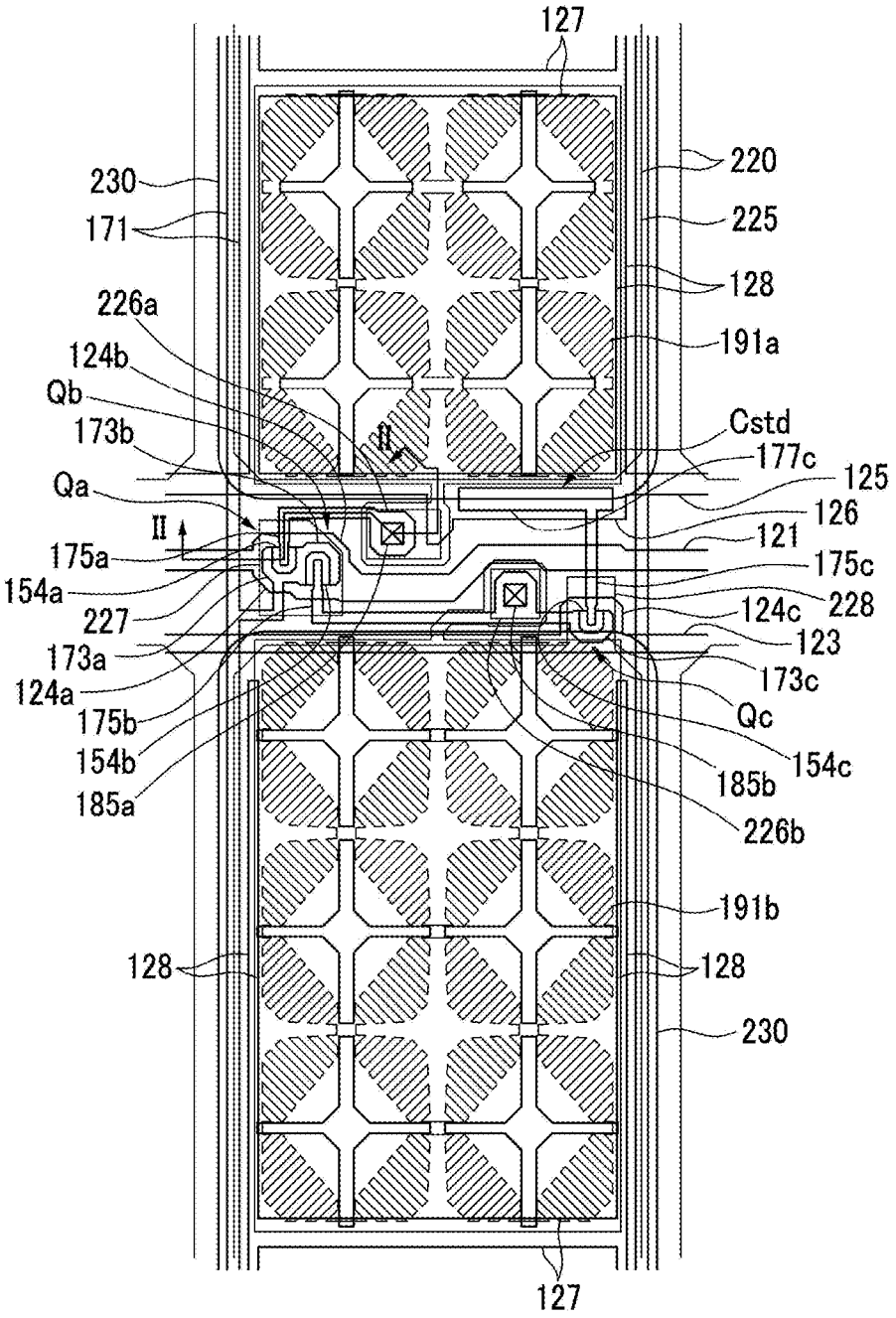
FIG. 21 shows a detailed configuration of a pixel according to an exemplary embodiment of the present invention.
Figure 22:
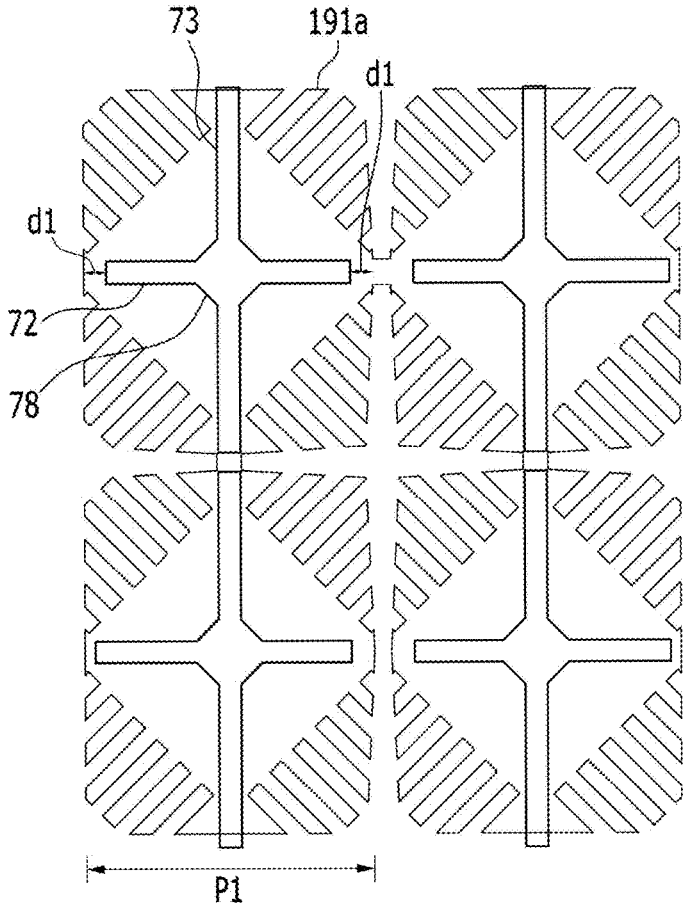
FIG. 22 shows shapes of a pixel electrode and a common electrode according to an exemplary embodiment of the present invention.
Figure 23:
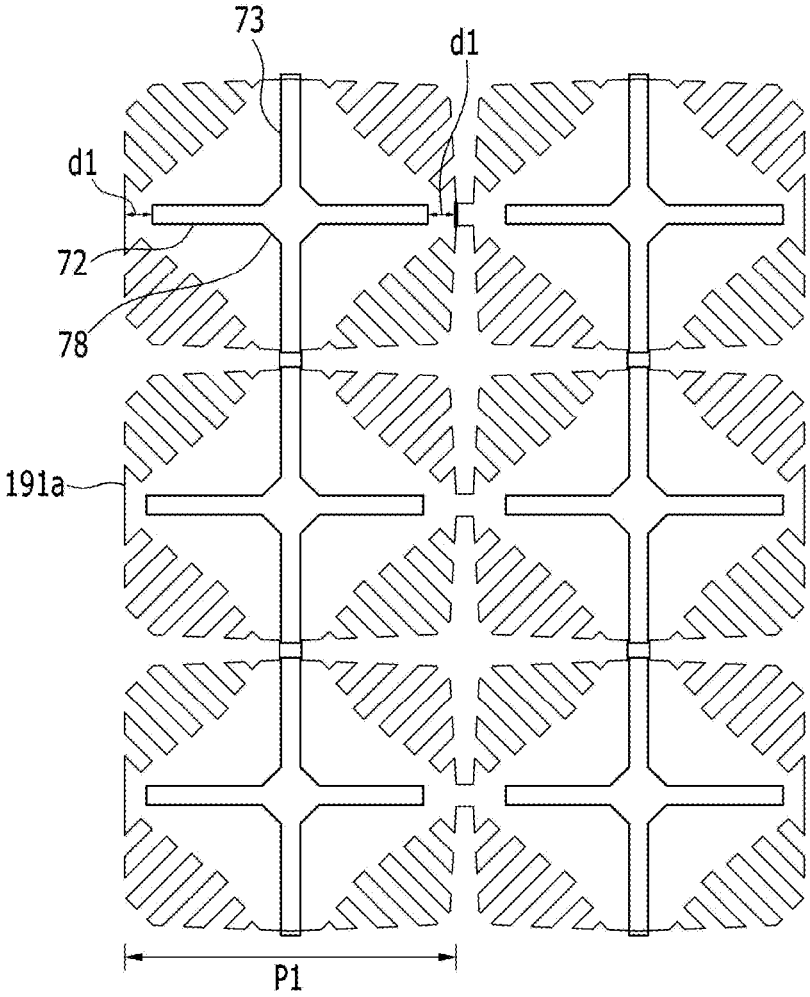
FIG. 23 shows shapes of a pixel electrode and a common electrode according to an exemplary embodiment of the present invention.

A liquid crystal display according to an exemplary embodiment of the present invention will now be described with reference to FIG. 21 to FIG. 23. FIG. 21 shows a detailed configuration of a pixel according to an exemplary embodiment of the present invention. FIG. 22 shows shapes of a pixel electrode and a common electrode according to an exemplary embodiment of the present invention. FIG. 23 shows shapes of a pixel electrode and a common electrode according to an exemplary embodiment of the present invention.

Referring to FIG. 21, a liquid crystal display in which a high-gray pixel electrode 191*a* is separately provided from a low-gray pixel electrode 191*b* with a gate line 121 therebetween. In FIG. 2, six individual unit pixel electrodes of the high-gray pixel electrode 191*a* are disposed in a 1×6 form, and six individual unit pixel electrodes of the low-gray pixel electrode 191*b* are also disposed in a 1×6 form. However in FIG. 21, four unit pixel electrodes of the high-gray pixel electrode 191*a* are disposed in a 2×2 form, and six unit pixel electrodes of the low-gray pixel electrode 191*b* are disposed in a 2×3 form. Depending on need, the high-gray pixel electrode 191*a* may be configured with six individual unit pixel electrodes and disposed in a 2×3 form, and the low-gray pixel electrode 191*b* may be configured with eight individual unit pixel electrodes and disposed in a 2×4 form.

FIG. 22 shows a high-gray pixel electrode 191*a* and a corresponding common electrode when four individual unit pixel electrodes of the high-gray pixel electrode 191*a* are disposed in a 2×2 form, and six individual unit pixel electrodes of the low-gray pixel electrode 191*b* are disposed in a 2×3 form.

In this instance, the common electrode horizontal opening 72 is reduced by D2 from respective sides compared to the horizontal width (P1) of one unit pixel electrode. That is, the horizontal opening of the common electrode facing the unit pixel electrode of the high-gray pixel electrode is shorter than the horizontal opening of the common electrode facing the unit pixel electrode of a low-gray pixel electrode (not shown). Therefore, in this case, disposal of the liquid crystal molecule with an angle greater than 45 degrees is prevented, and the lateral low-gray gamma lifting is improved.

In a like manner, FIG. 23 shows forms of a high-gray pixel electrode 191*a* and a corresponding common electrode when the high-gray pixel electrode 191*a* is configured with six individual unit pixel electrodes and is disposed in a 2×3 form, and the low-gray pixel electrode 191*b* is configured with eight individual unit pixel electrodes and is disposed in a 2×4 form.

In this instance, the common electrode horizontal opening 72 is reduced by D2 from respective sides compared to the horizontal width (P1) of one unit pixel electrode. That is, the horizontal opening of the common electrode facing the unit pixel electrode of the high-gray pixel electrode is shorter than the horizontal opening of the common electrode facing the unit pixel electrode of a low-gray pixel electrode (not shown). Therefore, in this case, the liquid crystal molecules do not have an angle greater than 45 degrees, and the lateral low-gray gamma lifting issue is improved.

An exemplary embodiment for modifying a voltage level of two subpixel electrodes will now be described according to circuit diagrams.

FIG. 24 to FIG. 28 show equivalent circuit diagrams of a pixel according to an exemplary embodiment of the present invention.

Figure 24:
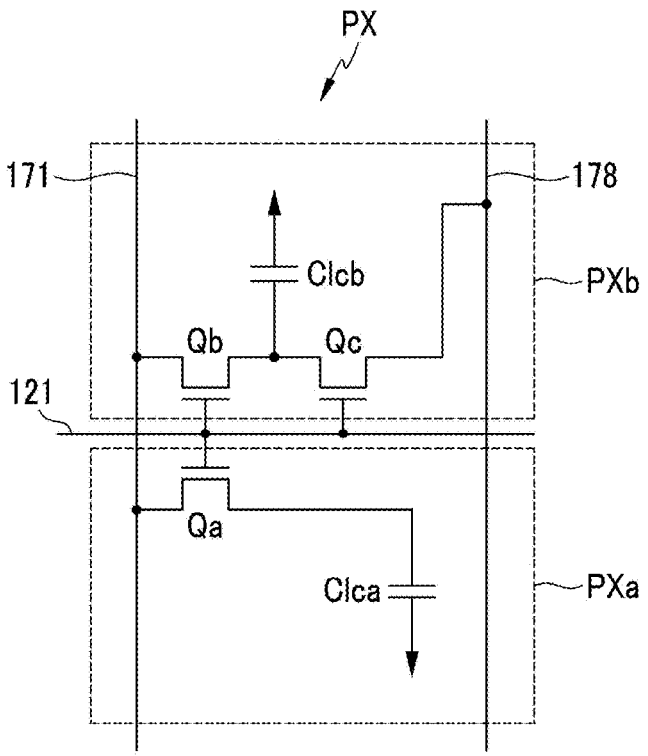
FIGS. 24, 25, 26, 27, and 28 show equivalent circuit diagrams of a pixel according to an exemplary embodiment of the present invention.

FIG. 24 shows a circuit diagram of a pixel for applying voltages having different voltage levels to two subpixel electrodes by using a reference voltage line 178.

In FIG. 24, the high-gray subpixel is shown as PXa, and the low-gray subpixel is shown as PXb.

Referring to FIG. 24, the liquid crystal display according to an exemplary embodiment of the present invention includes signal lines such as a gate line 121, a data line 171, and a reference voltage line 178. A pixel (PX) is connected to the signal lines.

The pixel (PX) includes first and second subpixels (PXa, PXb). The first subpixel (PXa) includes a first switching element (Qa) and a first liquid crystal capacitor (Clca), and the second subpixel (PXb) includes second and third switching elements (Qb, Qc) and a second liquid crystal capacitor (Clcb). The first switching element (Qa) and the second switching element (Qb) are connected to the gate line 121 and the data line 171. The third switching element (Qc) is connected to an output terminal of the second switching element Qb and the reference voltage line 178. An output terminal of the first switching element (Qa) is connected to the first liquid crystal capacitor (Clca), and an output terminal of the second switching element (Qb) is connected to input terminals of the second liquid crystal capacitor (Clcb) and the third switching element (Qc). The third switching element (Qc) includes a control terminal connected to the gate line 121, an input terminal connected to the second liquid crystal capacitor (Clcb), and an output terminal connected to the reference voltage line 178.

Regarding an operation of the pixel (PX) shown in FIG. 24, when a gate-on voltage (Von) is applied to the gate line 121, the first switching element (Qa), the second switching element (Qb), and the third switching element (Qc) connected thereto, are turned on. The data voltage applied to the data line 171 is applied to the first liquid crystal capacitor (Clca) and the second liquid crystal capacitor (Clcb) through the turned-on first switching element (Qa) and second switching element (Qb), respectively. The first liquid crystal capacitor (Clca) and the second liquid crystal capacitor (Clcb) are charged at a voltage that is the difference between the data voltage and the common voltage (Vcom). In this instance, the same data voltage is transmitted to the first liquid crystal capacitor (Clca) and the second liquid crystal capacitor (Clcb) through the first and second switching elements (Qa, Qb) and a charged voltage of the second liquid crystal capacitor (Clcb) is divided by the third switching element (Qc). The charged voltage of the second liquid crystal capacitor (Clcb) becomes less than a charged voltage of the first liquid crystal capacitor (Clca), and luminance of the two subpixels (PXa, PXb) may become different. Hence, the image seen from a lateral side of the screen of the liquid crystal display may be controlled to be more consistent with the image seen in the front by appropriately controlling the voltage charged in the first liquid crystal capacitor (Clca) and the charged voltage of the second liquid crystal capacitor (Clcb), thereby improving lateral visibility.

However, the configuration of the pixel (PX) of the liquid crystal display according to the exemplary embodiment of the present invention is not restricted to the exemplary embodiments shown in FIGS. 23 and 24.

Figure 25:
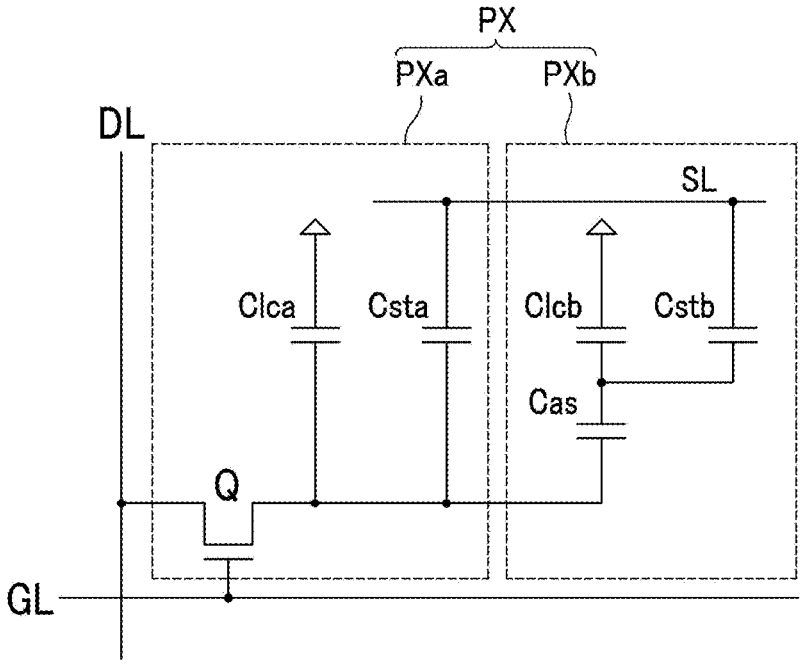

The exemplary embodiment shown in FIG. 25 will now be described. The liquid crystal display according to an exemplary embodiment of the present invention includes a plurality of gate lines (GL), a plurality of data lines (DL), a plurality of storage electrode lines (SL) and a plurality of pixels (PX) connected to the signal lines. Each pixel (PX) includes a pair of first and second subpixels (PXa, PXb). A first subpixel electrode is formed on the first subpixel (PXa), and a second subpixel electrode is formed on the second subpixel (PXb).

The liquid crystal display further includes a switching element (Q) connected to the gate line (GL) and the data line (DL), a first liquid crystal capacitor (Clca) and a first storage capacitor (Csta) connected to the switching element (Q) and formed on the first subpixel (PXa), a second liquid crystal capacitor (Clcb) and a second storage capacitor (Cstb) connected to the switching element (Q) and formed on the second subpixel (PXb), and an auxiliary capacitor (Cas) formed between the switching element (Q) and the second liquid crystal capacitor (Clcb).

The switching element (Q) may be a three-terminal element such as a thin film transistor provided on a lower panel, and includes a control terminal connected to the gate line (GL), an input terminal connected to the data line (DL), and an output terminal connected to the first liquid crystal capacitor (Clca), the first storage capacitor (Csta), and the auxiliary capacitor (Cas).

The auxiliary capacitor (Cas) includes a first terminal connected to the output terminal of the switching element (Q), and a second terminal connected to the second liquid crystal capacitor (Clcb) and the second storage capacitor (Cstb).

The charged voltage of the second liquid crystal capacitor (Clcb) becomes less than the charged voltage of the first liquid crystal capacitor (Clca) by the auxiliary capacitor (Cas), thereby improving lateral visibility of the liquid crystal display.

Figure 26:
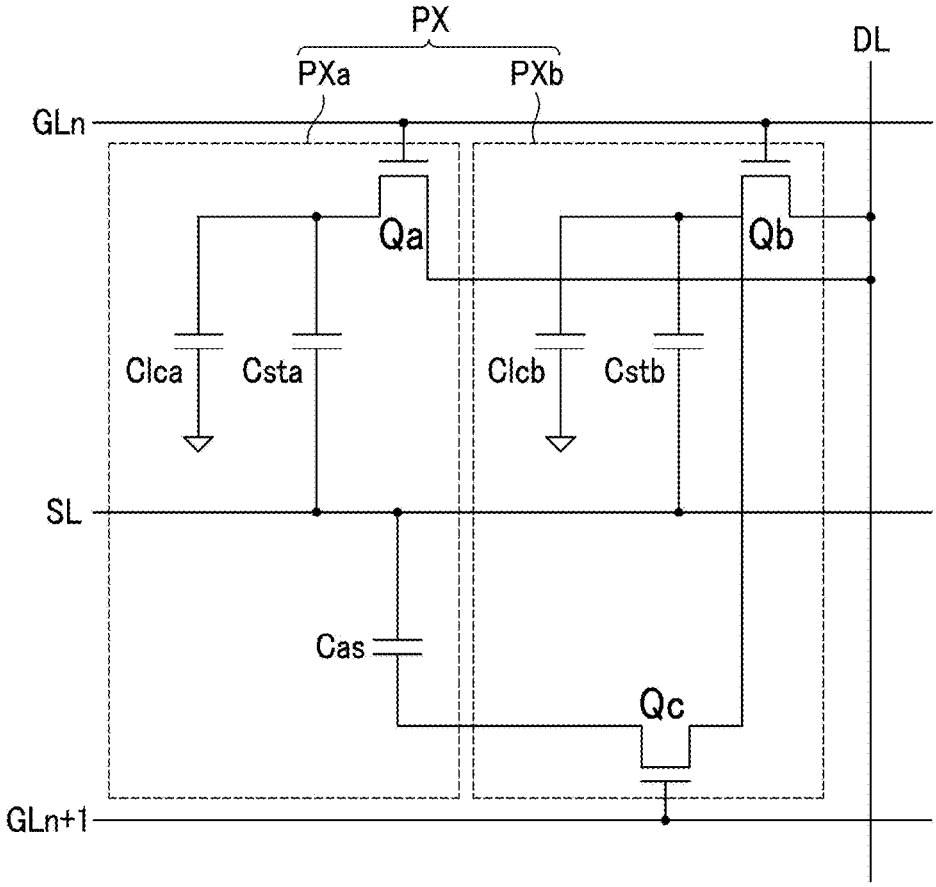

The exemplary embodiment of FIG. 26 will now be described. The liquid crystal display according to an exemplary embodiment of the present invention includes a plurality of gate lines (GLn, GLn+1), a plurality of data lines (DL), a plurality of storage electrode lines (SL), and a plurality of pixels (PX) connected to the signal lines. Each pixel (PX) includes a pair of first and second subpixels (PXa, PXb). A first subpixel electrode is formed on the first subpixel (PXa), and a second subpixel electrode is formed on the second subpixel (PXb).

The liquid crystal display according to an exemplary embodiment of the present invention further includes a first switching element (Qa) and a second switching element (Qb) connected to the gate line (GLn) and the data line (DL), a first liquid crystal capacitor (Clca) and a first storage capacitor (Csta) connected to the first switching element (Qa) and formed on the first subpixel (PXa), a second liquid crystal capacitor (Clcb) and a second storage capacitor (Cstb) connected to the second switching element (Qb) and formed on the second subpixel (PXb), a third switching element (Qc) connected to the second switching element (Qb) and switched by the next gate line (GLn+1), and an auxiliary capacitor (Cas) connected to the third switching element (Qc).

The first switching element (Qa) and the second switching element (Qb) may be three-terminal elements such as a thin film transistor provided on a lower panel, and include a control terminal connected to the gate line (GLn), an input terminal connected to the data line (DL), and an output terminal connected to the first liquid crystal capacitor (Clca), the first storage capacitor (Csta), the second liquid crystal capacitor (Clcb), and the second storage capacitor (Cstb).

The third switching element (Qc) also may be a three-terminal element such as a thin film transistor provided on a lower panel, and includes a control terminal connected to the next gate line (GLn+1), an input terminal connected to the second liquid crystal capacitor (Clcb), and an output terminal connected to the auxiliary capacitor (Cas).

The auxiliary capacitor (Cas) includes a first terminal connected to the output terminal of the third switching element (Qc) and a second terminal connected to the storage electrode line (SL).

Regarding an operation of the liquid crystal display according to an exemplary embodiment of the present invention, when the gate-on voltage is applied to the gate line (GLn), the first switching element and the second switching elements (Qa, Qb) connected thereto are turned on and the data voltage of the data line 171 is applied to the first and second subpixel electrodes.

When a gate-off voltage is applied to the gate line (GLn) and the gate-on voltage is applied to the next gate line (GLn+1), the first and second switching elements (Qa, Qb) are turned off and the third switching element (Qc) is turned on. Accordingly, charges of the second subpixel electrode (PXb) connected to the output terminal of the second switching element (Qb) flow to the auxiliary capacitor (Cas) to lower the voltage of the second liquid crystal capacitor (Clcb).

Lateral visibility of the liquid crystal display may be improved by differentiating the charged voltages of the first and second liquid crystal capacitors (Clca, Clcb).

Figure 27:
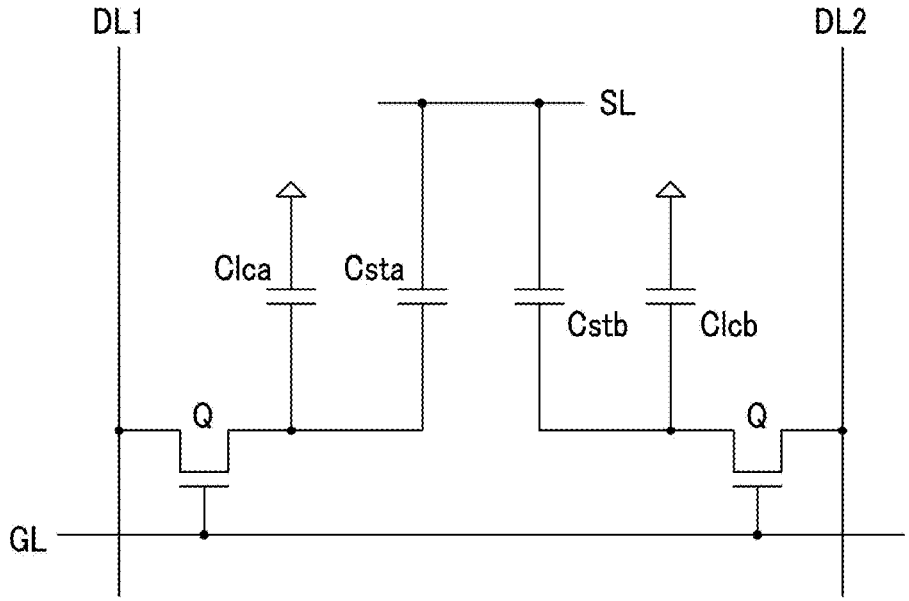

The exemplary embodiment shown in FIG. 27 will now be described. The liquid crystal display according to an exemplary embodiment of the present invention includes a plurality of gate lines (GL), a plurality of data lines (DL1, DL2), a plurality of storage electrode lines (SL), and a plurality of pixels connected to the signal lines. Each pixel includes a pair of first and second liquid crystal capacitors (Clca, Clab), and first and second storage capacitors (Csta, Cstb).

Each subpixel includes a liquid crystal capacitor and a storage capacitor, and additionally includes a thin film transistor (Q). The thin film transistors (Q) of the two subpixels belonging to one pixel are connected to the same gate line (GL) and are connected to the different data lines (DL1 and DL2). The different data lines (DL1 and DL2) simultaneously apply the data voltage with different levels so that the first and second liquid crystal capacitors (Clca, Clcb) of the two subpixels may have different charged voltages. As a result, lateral visibility of the liquid crystal display may be improved.

Figure 28:
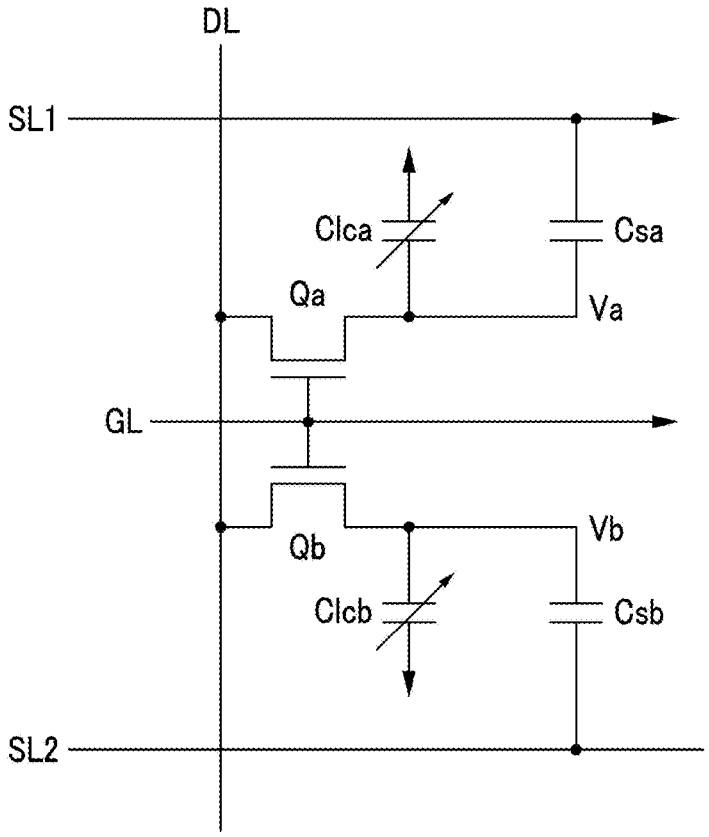

The exemplary embodiment of FIG. 28 will now be described. As shown in FIG. 28, the liquid crystal display according to an exemplary embodiment of the present invention includes a gate line (GL), a data line (DL), a first power line (SL1), a second power line (SL2), and a first switching element (Qa) and a second switching element (Qb) connected to the gate line (GL) and the data line (DL).

The liquid crystal display according to an exemplary embodiment of the present invention further includes an auxiliary step-up capacitor (Csa) and a first liquid crystal capacitor (Clca) connected to the first switching element (Qa), and an auxiliary step-down capacitor (Csb) and a second liquid crystal capacitor (Clcb) connected to the second switching element (Qb).

The first switching element (Qa) and the second switching element (Qb) may be configured with three-terminal elements such as a thin film transistor. The first switching element (Qa) and second switching element (Qb) are connected to the same gate line (GL) and the same data line (DL), are turned on at the same time, and output the same data signal.

A voltage that swings with a predetermined period is applied to the first power line (SL1) and the second power line (SL2). A first low voltage is applied to the first power line (SL1) for a predetermined period (e.g., 1H) and a first high voltage is applied thereto for a predetermined next period. A second high voltage is applied to the second power line (SL2) for a predetermined period, and a second low voltage is applied to it for a predetermined next period. In this instance, the first period and the second period are repeated multiple times for one frame so the swinging voltage is applied to the first power line (SL1) and the second power line (SL2). The first low voltage may correspond to the second low voltage, and the first high voltage may correspond to the second high voltage.

The auxiliary step-up capacitor (Csa) is connected to the first switching element Qa and the first power line (SL1), and the auxiliary step-down capacitor (Csb) is connected to the second switching element (Qb) and the second power line (SL2).

A voltage (Va) at a terminal (hereinafter a first terminal) at a portion where the auxiliary step-up capacitor (Csa) is connected to the first switching element (Qa) is reduced when the first low voltage is applied to the first power line (SL1), and it is increased when the first high voltage is applied thereto. When the voltage of the first power line (SL1) swings, the voltage (Va) at the first terminal also swings.

In addition, a voltage (Vb) at a terminal (hereinafter a second terminal), at a portion where the auxiliary step-down capacitor (Csb) is connected to the first switching element (Qb), is increased when the second high voltage is applied to the second power line (SL2), and it is reduced when the second low voltage is applied thereto. When the voltage of the second power line (SL2) swings, the voltage (Vb) at the second terminal also swings.

Thus, when the same data voltage is applied to the two subpixels, the voltages (Va, Vb) of the pixel electrodes of the two subpixels are able to be changed by the voltage that swings on the first and second power lines (SL1) and (SL2) through which transmittance of the two subpixels may be made different and lateral visibility may be improved.

No reference voltage line has been used in the exemplary embodiments shown in FIG. 25 to FIG. 28, but a predetermined line that is parallel to the data line may perpendicularly cross the center of the display area of the pixel, and thereby improve display quality.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a plurality of pixels disposed on an insulation substrate in a first direction, each pixel of the plurality of pixels comprising a thin film transistor region and a display area; and a reference voltage line extending along a center of the display area in a second direction perpendicular to the first direction, wherein the display area comprises a plurality of domains disposed in two rows, a domain in one of the two rows comprises a high-gray subpixel area comprising a high-gray pixel electrode, and a domain in the other of the two rows comprises a low-gray subpixel area comprising a low-gray pixel electrode, the high-gray pixel electrode and the low-gray pixel electrode each comprise a plurality of unit pixel electrodes, each unit pixel electrode comprising a center electrode having a planar structure and a plurality of branches that extend from at least one side of the center electrode, and a maximum value from among horizontal widths of the center electrode of the unit pixel electrode of the high-gray pixel electrodes is shorter in length than a maximum value from among horizontal widths of the center electrode of the unit pixel electrodes of the low-gray pixel electrode.

2. The liquid crystal display of claim 1, wherein the horizontal width of the center electrode of the unit pixel electrode of the high-gray subpixel area is shorter in length than a vertical height of the center electrode.

3. The liquid crystal display of claim 2, wherein an angle between a virtual line that horizontally crosses the center electrode of the unit pixel electrode of the high-gray subpixel area and a progression start line of a branch extended from the center electrode is greater than 45 degrees.

4. The liquid crystal display of claim 1, wherein the high-gray subpixel area comprises six domains, and the low-gray subpixel area comprises six domains.

5. The liquid crystal display of claim 4, wherein the high-gray subpixel area and the low-gray subpixel area face the high-gray pixel electrode and the low-gray pixel electrode, respectively, and comprise a common electrode comprising an opening.

6. The liquid crystal display of claim 5, wherein the opening in the common electrode is a cross-shaped opening comprising a horizontal opening and a vertical opening crossing the horizontal opening, and a center opening disposed in a center portion of the cross-shaped opening.

7. The liquid crystal display of claim 6, wherein a length of the horizontal opening in the common electrode facing the unit pixel electrode of the high-gray pixel electrode is shorter in length than a length of the horizontal opening in the common electrode facing the unit pixel electrode of the low-gray pixel electrode.

8. The liquid crystal display of claim 7, wherein the horizontal opening in the common electrode facing the high-gray pixel electrode is 5 um to 9 um shorter in length of the opening than the length of each end of the horizontal opening in the common electrode facing the low-gray pixel electrode.

9. The liquid crystal display of claim 7, wherein the horizontal opening in the common electrode facing the high-gray pixel electrode is equal to or shorter in length than the vertical opening in the common electrode.

10. A liquid crystal display, comprising:

a plurality of pixels disposed on an insulation substrate in a first direction, each pixel of the plurality of pixels comprising a thin film transistor region and a display area;

a reference voltage line extending along a center of the display area in a second direction perpendicular to the first direction, wherein the display area comprises a plurality of domains disposed in two rows, a domain in one of the two rows comprises a high-gray subpixel area comprising a high-gray pixel electrode, and a domain in the other of the two rows comprises a low-gray subpixel area comprising a low-gray pixel electrode, the high-gray pixel electrode and the low-gray pixel electrode each comprise a plurality of unit pixel electrodes; and common electrodes respectively facing the high-gray pixel electrode and the low-gray pixel electrode, the common electrodes each comprising a horizontal opening and a vertical opening crossing the horizontal opening, wherein the horizontal opening in the common electrode facing the unit pixel electrode of the high-gray pixel electrode is shorter in length than the horizontal opening in the common electrode facing the unit pixel electrode of the low-gray pixel electrode.

11. The liquid crystal display of claim 10, wherein the horizontal opening in the common electrode facing the high-gray pixel electrode is 5 um to 9 um shorter in length at each end of the opening than the length of the horizontal opening in the common electrode facing the low-gray pixel electrode.

12. The liquid crystal display of claim 10, wherein the horizontal opening in the common electrode facing the high-gray pixel electrode is equal to or shorter in length than the vertical opening in the common electrode.

13. The liquid crystal display of claim 10, wherein an angle between the horizontal opening in the common electrode and a virtual line that connects one end of the horizontal opening in the common electrode facing the high-gray pixel electrode and one end of the vertical opening in the common electrode is greater than 45 degrees.

14. A liquid crystal display, comprising:

a plurality of pixels disposed on an insulation substrate in a first direction, each pixel of the plurality of pixels comprising a thin film transistor region and a display area;

a gate line extending along a center of the display area in a second direction perpendicular to the first direction, wherein the display area comprises a plurality of domains that are arranged in two columns, a domain disposed on an upper part with respect to the gate line is a high-gray subpixel area comprising a high-gray subpixel electrode, and a domain disposed on a lower part with respect to the gate line comprises a low-gray subpixel area comprising low-gray pixel electrode, the high-gray pixel electrode and the low-gray pixel electrode each comprise a plurality of unit pixel electrodes; and common electrodes respectively facing the high-gray pixel electrode and the low-gray pixel electrode, wherein a horizontal opening and a vertical opening crossing the horizontal opening are formed in the common electrode, and the horizontal opening in the common electrode facing the unit pixel electrode of the high-gray pixel electrode is shorter in length than the horizontal opening in the common electrode facing the unit pixel electrode of the low-gray pixel electrode.

15. The liquid crystal display of claim 14, wherein the horizontal opening in the common electrode facing the high-gray pixel electrode is 5 um to 9 um shorter in length of the opening than the length of the horizontal opening in the common electrode facing the low-gray pixel electrode.

16. The liquid crystal display of claim 14, wherein the horizontal opening in the common electrode facing the high-gray pixel electrode is equal to or shorter in length than the vertical opening in the common electrode.

17. The liquid crystal display of claim 14, wherein an angle between the horizontal opening in the common electrode and a virtual line that connects one end of the horizontal opening in the common electrode facing the high-gray pixel electrode and one end of the vertical opening in the common electrode is greater than 45 degrees.

18. The liquid crystal display of claim 14, wherein the high-gray subpixel area comprises four domains, and the low-gray subpixel area comprises six domains.

19. The liquid crystal display of claim 14, wherein the high-gray subpixel area comprises six domains, and the low-gray subpixel area comprises eight domains.

* * * * *